US010920799B2

(12) United States Patent
Bianchi et al.

(10) Patent No.: US 10,920,799 B2
(45) **Date of Patent: *Feb. 16, 2021**

(54) HYDRAULIC SYSTEM WITH A COUNTERBALANCE VALVE CONFIGURED AS A METER-OUT VALVE AND CONTROLLED BY AN INDEPENDENT PILOT SIGNAL

(71) Applicant: Sun Hydraulics, LLC, Sarasota, FL (US)

(72) Inventors: Riccardo Bianchi, Sarasota, FL (US); Steven T. Weber, Sarasota, FL (US)

(73) Assignee: Sun Hydraulics, LLC, Sarasota, FL (US)

( * ) Notice: Subject to any disclaimer, the term of this patent is extended or adjusted under 35 U.S.C. 154(b) by 39 days.

This patent is subject to a terminal disclaimer.

(21) Appl. No.: 16/541,279

(22) Filed: Aug. 15, 2019

(65) Prior Publication Data

US 2019/0368516 A1 Dec. 5, 2019

Related U.S. Application Data

(63) Continuation of application No. 15/940,434, filed on Mar. 29, 2018, now Pat. No. 10,428,845.

(51) Int. Cl.

| | |
|---|---|
| ***F15B 11/044*** | (2006.01) |
| ***F15B 13/01*** | (2006.01) |
| ***F15B 11/00*** | (2006.01) |

(52) U.S. Cl.

CPC ..... *F15B 13/015* (2013.01); *F15B 11/003* (2013.01); *F15B 11/0445* (2013.01)

(58) Field of Classification Search

CPC ..... F15B 11/003; F15B 11/0445; F15B 2211/6306; F15B 2211/6309

See application file for complete search history.

(56) References Cited

U.S. PATENT DOCUMENTS 4,537,029 A ‡ 8/1985 Gunda ..... E02F 9/2217 60/390
4,586,332 A ‡ 5/1986 Schexnayder ..... E02F 9/123 60/468

(Continued)

FOREIGN PATENT DOCUMENTS

WO WO 2015/164321 10/2015
WO WO 2015/164321 A1 ‡ 10/2015

(Continued)

*Primary Examiner* — Kevin F Murphy
(74) *Attorney, Agent, or Firm* — McDonnell Boehnen Hulbert & Berghoff LLP

(57) ABSTRACT

An example valve assembly includes a meter-in valve configured to be fluidly coupled to a first source of pressurized fluid and control fluid flow from the first source of pressurized fluid into a first chamber of an actuator; a counterbalance valve including configured to open and control fluid flow from a second chamber of the actuator to a tank in response to a pilot pressure fluid signal received at a pilot port of the counterbalance valve; and a pressure reducing valve configured to be fluidly coupled to a second source of pressurized fluid and to be fluidly coupled to the pilot port of the counterbalance valve, where the pressure reducing valve is configured to receive pressurized fluid from the second source of pressurized fluid and, when actuated, provide the pilot pressure fluid signal to the pilot port of the counterbalance valve.

20 Claims, 7 Drawing Sheets

(56) References Cited

U.S. PATENT DOCUMENTS

| | | | | |
|---|---|---|---|---|
| 4,753,157 | A ‡ | 6/1988 | Lonnemo | F15B 13/02 137/59 |
| 5,197,508 | A ‡ | 3/1993 | Gottling | F16K 11/04 137/1 |
| 5,960,695 | A ‡ | 10/1999 | Aardema | F15B 11/006 137/59 |
| 6,196,247 | B1 ‡ | 3/2001 | Knoell | A01B 63/1013 137/12 |
| 6,244,048 | B1 ‡ | 6/2001 | Tanaka | E02F 9/2242 60/421 |
| 6,694,860 | B2 ‡ | 2/2004 | Yoshino | F15B 11/006 60/468 |
| 7,066,446 | B2 ‡ | 6/2006 | Nielsen | F15B 11/042 251/12 |
| 7,194,947 | B2 ‡ | 3/2007 | Mentink | B60J 7/1273 91/420 |
| 7,219,592 | B2 ‡ | 5/2007 | Nielsen | F15B 11/024 91/437 |
| 7,251,935 | B2 ‡ | 8/2007 | Zhang | F15B 11/006 60/461 |
| 8,516,944 | B2 ‡ | 8/2013 | Desbois-Renaudin | F15B 11/003 91/433 |
| 8,726,646 | B2 ‡ | 5/2014 | Riedel | F15B 11/163 60/422 |
| 9,476,436 | B2 ‡ | 10/2016 | Ogawa | F15B 11/17 |
| 9,810,242 | B2 ‡ | 11/2017 | Wang | B66C 13/066 |
| 10,428,845 | B1 * | 10/2019 | Bianchi | F15B 13/029 |
| 2005/0051025 | A1 ‡ | 3/2005 | Nielsen | F15B 11/024 91/462 |
| 2016/0298719 | A1 * | 10/2016 | Wang | E02F 9/2207 |
| 2017/0108015 | A1 ‡ | 4/2017 | Kleitsch | F15B 11/163 |
| 2017/0198831 | A1 ‡ | 7/2017 | Beschorner | G01M 3/2876 |
| 2018/0180066 | A1 ‡ | 6/2018 | Rygaard Hansen | F15B 21/008 |

FOREIGN PATENT DOCUMENTS

| | | |
|---|---|---|
| WO | WO 2016/200272 | 12/2016 |
| WO | WO 2016/200272 A1 ‡ | 12/2016 |

* cited by examiner
‡ imported from a related application

HYDRAULIC SYSTEM WITH A COUNTERBALANCE VALVE CONFIGURED AS A METER-OUT VALVE AND CONTROLLED BY AN INDEPENDENT PILOT SIGNAL

CROSS REFERENCE TO RELATED APPLICATION

The present application is a continuation of U.S. patent application Ser. No. 15/940,434, filed on Mar. 29, 2018, and entitled "Hydraulic System with a Counterbalance Valve Configured as a Meter-Out Valve and Controlled by an Independent Pilot Sign," the entire contents of which are herein incorporated by reference as if fully set forth in this description.

BACKGROUND

Counterbalance valves are hydraulic valves configured to hold and control negative or gravitational loads. They may be configured to operate, for example, in applications that involve the control of suspended loads, such as mechanical joints, lifting applications, extensible movable bridge, winches, etc.

In some applications, the counterbalance valve, which may also be referred to as an overcenter valve, could be used as a safety device that prevents an actuator from moving if a failure occurs (e.g., a hose burst) or could be used as a load holding valve (e.g., on a boom cylinder of a mobile machinery). The counterbalance valve allows cavitation-free load lowering, preventing the actuator from overrunning when pulled by the load (gravitational load).

As an example, a pilot-operated counterbalance valve could be used on the return side of a hydraulic actuator for lowering a large negative load in a controlled manner. The counterbalance valve generates a preload or back-pressure in the return line that acts against the main drive pressure so as to maintain a positive load, which therefore remains controllable. Particularly, if a speed of a piston of the cylinder increases, pressure on one side of the cylinder (e.g., rod side) may drop and the counterbalance valve may then act to restrict the flow to controllably lower the load.

When a directional control valve is operating in a load-lowering mode, the pilot-operated counterbalance valve is opened by a pressurized pilot line. To protect both directions of motion of a fluid receiving device against a negative load, a respective counterbalance valve may be assigned to each of the ports of the fluid receiving device. Each counterbalance valve assigned to a particular port may then be controlled open via cross-over by the pressure present at the other port. In other words, a respective pressurized pilot line that, when pressurized, opens a counterbalance valve is connected to a supply line connected to the other port. This configuration might generate a high pressure level in the supply line, thereby causing a power loss in the hydraulic system rendering the hydraulic system inefficient under some operating conditions.

It is with respect to these and other considerations that the disclosure made herein is presented.

SUMMARY

The present disclosure describes implementations that relate to a hydraulic system with a counterbalance valve configured as a meter-out valve and controlled by an independent pilot signal.

In a first example implementation, the present disclosure describes a valve assembly. The valve assembly includes: (i) a meter-in valve configured to be fluidly coupled to a first source of pressurized fluid and control fluid flow from the first source of pressurized fluid into a first chamber of an actuator; (ii) a counterbalance valve comprising: (a) a first port configured to be fluidly coupled to a second chamber of the actuator, (b) a second port configured to be fluidly coupled to a tank, and (c) a pilot port, where the counterbalance valve is configured to open and control fluid flow from the second chamber to the tank in response to a pilot pressure fluid signal received at the pilot port; and (iii) a pressure reducing valve configured to be fluidly coupled to a second source of pressurized fluid and to be fluidly coupled to the pilot port of the counterbalance valve, where the pressure reducing valve is configured to receive pressurized fluid from the second source of pressurized fluid and, when actuated, provide the pilot pressure fluid signal to the pilot port of the counterbalance valve, where the pilot pressure fluid signal has a reduced pressure level compared to pressurized fluid received from the second source of pressurized fluid.

In a second example implementation, the present disclosure describes another valve assembly. The valve assembly includes: (i) a first meter-in valve configured to be fluidly coupled to a first source of pressurized fluid and control fluid flow from the first source of pressurized fluid into a first chamber of an actuator; (ii) a second meter-in valve configured to control fluid flow from the first source of pressurized fluid into a second chamber of the actuator; (iii) a first counterbalance valve comprising: (a) a first port configured to be fluidly coupled to the second chamber of the actuator, (b) a second port configured to be fluidly coupled to a tank, and (c) a pilot port, where the first counterbalance valve is configured to open and control fluid flow from the second chamber to the tank in response to a pilot pressure fluid signal received at the pilot port; (iv) a second counterbalance valve comprising: (a) a respective first port configured to be fluidly coupled to the first chamber of the actuator, (b) a respective second port configured to be fluidly coupled to the tank, and (c) a respective pilot port, where the second counterbalance valve is configured to open and control fluid flow from the first chamber to the tank in response to a respective pilot pressure fluid signal received at the respective pilot port; (v) a first pressure reducing valve configured to be fluidly coupled to a second source of pressurized fluid and to be fluidly coupled to the pilot port of the first counterbalance valve, where the first pressure reducing valve is configured to receive pressurized fluid from the second source of pressurized fluid and, when actuated, provide the pilot pressure fluid signal to the pilot port of the first counterbalance valve; and (vi) a second pressure reducing valve configured to be fluidly coupled to the second source of pressurized fluid and to be fluidly coupled to the respective pilot port of the second counterbalance valve, where the second pressure reducing valve is configured to receive pressurized fluid from the second source of pressurized fluid and, when actuated, provide the respective pilot pressure fluid signal to the respective pilot port of the second counterbalance valve.

In a third example implementation, the present disclosure describes a hydraulic system. The hydraulic system includes: a first source of pressurized fluid; a second source of pressurized fluid; a tank; an actuator having a first chamber and a second chamber; and a valve assembly. The valve assembly includes: (i) a meter-in valve configured to be fluidly coupled to the first source of pressurized fluid and control fluid flow from the first source of pressurized fluid into the first chamber of the actuator; (ii) a counterbalance valve comprising: (a) a first port configured to be fluidly coupled to the second chamber of the actuator, (b) a second port configured to be fluidly coupled to the tank, and (c) a pilot port, where the counterbalance valve is configured to open and control fluid flow from the second chamber to the tank in response to a pilot pressure fluid signal received at the pilot port; and (iii) a pressure reducing valve configured to be fluidly coupled to the second source of pressurized fluid and to be fluidly coupled to the pilot port of the counterbalance valve, where the pressure reducing valve is configured to receive pressurized fluid from the second source of pressurized fluid and, when actuated, provide the pilot pressure fluid signal to the pilot port of the counterbalance valve, where the pilot pressure fluid signal has a reduced pressure level compared to pressurized fluid received from the second source of pressurized fluid.

The foregoing summary is illustrative only and is not intended to be in any way limiting. In addition to the illustrative aspects, implementations, and features described above, further aspects, implementations, and features will become apparent by reference to the figures and the following detailed description.

DETAILED DESCRIPTION

A counterbalance valve may have a spring that acts against a movable element (e.g., a spool or a poppet), and the force of the spring determines a pressure setting of the counterbalance valve. The pressure setting is a pressure level that causes the counterbalance valve to open and allow fluid flow therethrough. In examples, the counterbalance valve is configured to have a pressure setting that is higher (e.g., 30% higher) than an expected maximum induced pressure in an actuator controlled by the counterbalance valve. The counterbalance valve is configured to open when a combined force resulting from action of load pressure induced at one port (e.g., within one chamber) of the actuator and action of a pilot pressure signal generated at the other port (e.g., the other chamber) of the actuator overcomes the pressure setting of the counterbalance valve.

In examples, an actuator may operate a particular tool that experiences a high load in some cases; however, the actuator may operate another tool that experiences small load in other cases. In the cases where the actuator operates a tool that experiences a small load, having the pilot line connected to the supply line to the other port of the actuator can cause the hydraulic system to be inefficient. Particularly, the hydraulic system needs to provide a high pilot pressure to open the counterbalance valve, and the counterbalance generates a large backpressure thereby causing the system to consume an extra amount of power or energy.

As another example, an actuator of a mobile machinery may be coupled to the machine at a hinge. As the actuator rotates about the hinge, the kinematics of the actuator change and the load may increase or decrease based on the rotational position of the actuator. In some rotational positions, the load may be large causing a high induced pressure, but in other rotational positions the load may be small causing a low induced pressure.

Configuring the counterbalance valve with a cross-over pilot signal may render operation of the hydraulic system inefficient when the load is small. When the load is small, a large pilot pressure might need to be provided to open the counterbalance valve and a large backpressure is generated. The large pilot pressure causes the pressure level in the supply line to the inlet port of the actuator to increase. The increased pressure level multiplied by flow through the actuator results in an energy loss that could have been avoided if the pilot signal is derived from a different source, rather than the supply line to the actuator.

Therefore, it may be desirable to have a counterbalance valve with a pilot signal derived from an independent source, rather than from the supply line to the other port, so as to avoid affecting pressure level in the supply line.

Figure 1:
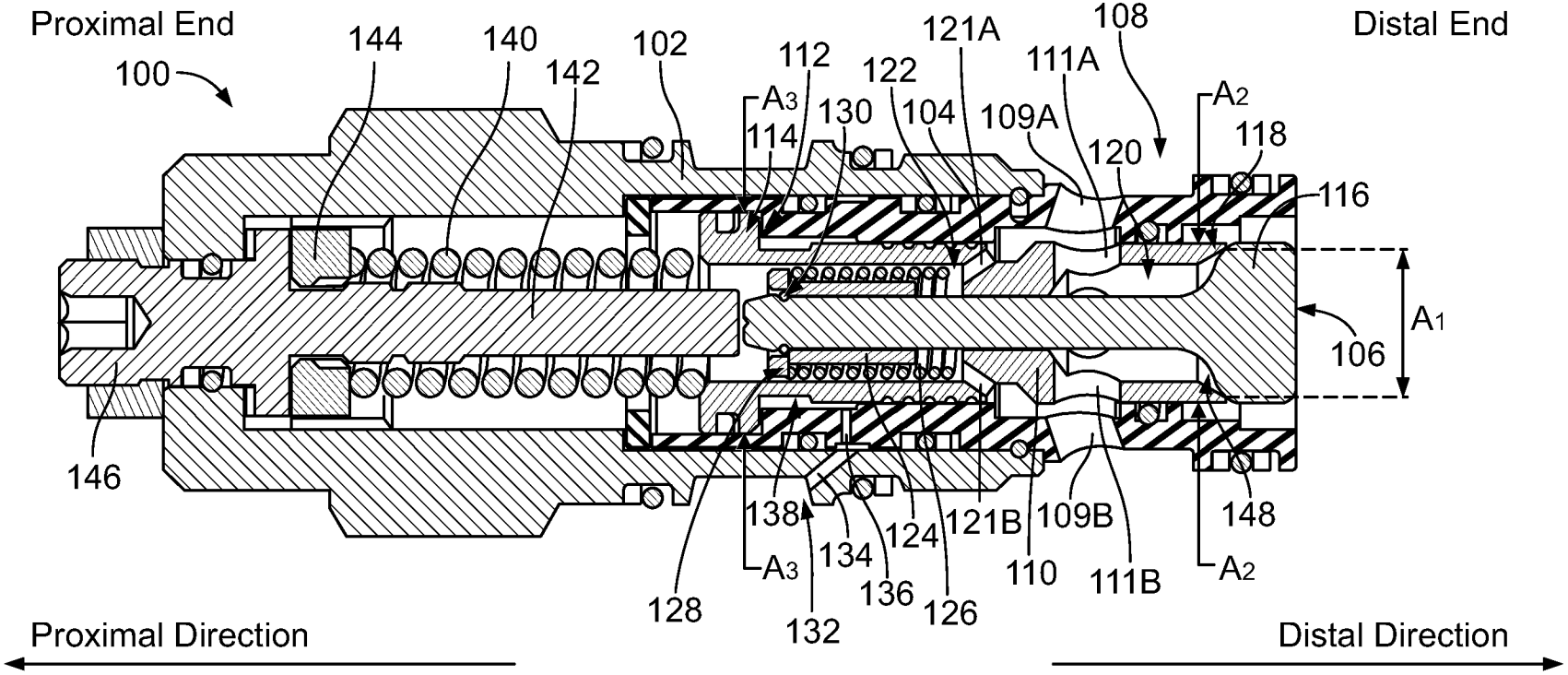
FIG. 1 illustrates a cross-sectional side view of a counterbalance valve, in accordance with an example implementation.

FIG. 1 illustrates a cross-sectional side view of a counterbalance valve 100, in accordance with an example implementation. The counterbalance valve 100 may be inserted or screwed into a manifold having ports corresponding to ports of the counterbalance valve 100 described below, and may thus fluidly couple the counterbalance valve 100 to other components of a hydraulic system.

The counterbalance valve 100 includes a housing 102 that defines a longitudinal cylindrical cavity therein. The counterbalance valve 100 also includes a sleeve 104 received at a distal or first end of the housing 102, and the sleeve 104 is coaxial with the housing 102. The sleeve 104 defines a first port 106 and a second port 108. The first port 106 is defined at a nose or distal end of the sleeve 104 and can be referred to as a load port, for example. The second port 108 may include a set of cross holes such as cross holes 109A, 109B disposed in a radial array about an exterior surface of the sleeve 104. In examples, the second port 108 could be referred to as a tank port or exhaust port.

The sleeve 104 defines a respective longitudinal cylindrical cavity therein. The counterbalance valve 100 includes a piston 110 disposed, and slidably accommodated, in the longitudinal cylindrical cavity of the sleeve 104. The sleeve 104 includes a shoulder 112 defined by an interior peripheral surface of the sleeve 104. The piston 110 includes a flanged portion 114 that rests against the shoulder 112 of the sleeve 104 when the counterbalance valve 100 is in a closed position that precludes flow from the first port 106 to the second port 108.

The piston 110 defines longitudinal cylindrical cavity therein. The counterbalance valve 100 includes a poppet 116 disposed, and slidably accommodated, in the longitudinal cylindrical cavity of the piston 110. The piston 110 defines a poppet seat 118 at a tip of the piston 110. The poppet 116 rests against the poppet seat 118 when the counterbalance valve 100 is in a closed position. Further, the piston 110 includes cross holes, such as cross holes 111A, 111B disposed in a radial array about an exterior surface of the piston 110. The cross holes (e.g., the cross holes 111A, 111B) of the piston 110 are fluidly coupled to the second port 108 via the cross holes 109A, 109B. With this configuration, a chamber 120 formed within the longitudinal cylindrical cavity of the piston 110 is fluidly coupled to the second port 108. Further, slanted cross holes or channels 121A, 121B formed in the piston 110 fluidly couple the second port 108 to a chamber 122 formed within the longitudinal cylindrical cavity of the piston 110.

The chamber 122 of the piston 110 houses a collar 124 and a spring 126. The collar 124 is configured as a sleeve disposed about an exterior peripheral surface of the poppet 116. A distal end of the spring 126 rests against an interior surface of the piston 110 that bounds the chamber 122, whereas a proximal end of the spring 126 rests against a flange 128 formed on an exterior surface of the collar 124. With this configuration, the spring 126 biases the collar 124 in the proximal direction.

A wire 130 (e.g., a protrusion) is disposed about the exterior peripheral surface of the poppet 116 toward the proximal end. The wire 130 enables the collar 124 to interact with the poppet 116. For instance, if the poppet 116 moves in a distal direction (e.g., to the right in FIG. 1), the wire 130 engages the interior peripheral surface of the collar 124 and causes the collar 124 to move in the distal direction as well. Similarly, as the spring 126 applies a force on and biases the collar 124 in the proximal direction, the force is transferred to the poppet 116 via the wire 130, thereby causing the poppet 116 to remain seated at the poppet seat 118.

The housing 102 further defines a pilot port 132 on an exterior peripheral surface of the housing 102. Cross holes such as cross hole 134 are disposed in the housing 102 and configured to communicate a pilot pressure fluid signal received at the pilot port 132 to cross holes such as cross hole 136 disposed in the sleeve 104. The cross holes (e.g., the cross hole 136) of the sleeve 104 communicate the pilot pressure fluid signal to an annular area 138 formed between an exterior peripheral surface of the piston 110 and an interior peripheral surface of the sleeve 104. The pilot pressure fluid signal can thus apply a force on a distal surface of the flanged portion 114 of the piston 110 in the proximal direction (e.g., to the left in FIG. 1).

The counterbalance valve 100 further includes a setting spring 140 disposed within the housing 102. The setting spring 140 is disposed about an exterior surface of a pin 142. A distal end of the pin 142 is adjacent to a proximal end of the poppet 116 as shown in FIG. 1. A distal end of the setting spring 140 rests against a proximal end of the poppet 116, whereas a proximal end of the setting spring 140 rests against a plunger or plug 144. The plug 144 interfaces with a set screw 146 disposed at a proximal end of the counterbalance valve 100. In the configuration shown in FIG. 1, the pin 142 is integrated with the set screw 146; however, in other configuration, the pin 142 can be a separate component coupled or affixed to the set screw 146.

Once the set screw 146 is screwed into the counterbalance valve 100 to a particular axial position, the set screw 146 and the plug 144 assume a particular fixed position. With this configuration, the proximal end of the setting spring 140 resting against the plug 144 is fixed, whereas the distal end of the setting spring 140 resting against the piston 110 is movable and biases the piston 110 in the distal direction. As such, the setting spring 140 applies a biasing or preload force on the piston 110 in the distal direction. As the setting spring 140 applies the biasing force on the piston 110 in the distal direction, and the spring 126 applies a force on the poppet 116 in the proximal direction, the poppet 116 remains seated at the poppet seat 118 when the counterbalance valve 100 is in the closed position.

The biasing force of the setting spring 140 determines the pressure setting of the counterbalance valve 100 as described below. The set screw 146 is configured for mechanical or manual adjustment of the pressure setting of the counterbalance valve 100. For example, if the set screw 146 is rotated in a first direction (e.g., in a clockwise direction), the set screw 146 may move axially in the distal direction (e.g., to the right in FIG. 1) pushing the plug 144 in the distal direction. The plug 144 in turn pushes and compresses the setting spring 140, thus increasing the preload or biasing force of the setting spring 140.

Conversely, rotating the set screw 146 in a second direction (e.g., counter-clockwise) causes the set screw 146 to move axially in the proximal direction, allowing the setting spring 140 to push plug 144 in the proximal direction. The length of the setting spring 140 thus increases and the preload or biasing force of the setting spring 140 is reduced. With this configuration, the biasing force of the setting spring 140, and thus the pressure setting of the counterbalance valve 100, can be adjusted via the set screw 146.

The counterbalance valve 100 is configured to operate in different modes of operation. In a first mode of operation, the counterbalance valve 100 allows reverse flow from the second port 108 to the first port 106. In this mode of operation, pressurized fluid is received at the second port 108, and the counterbalance valve 100 allows fluid to flow from the second port 108 to the first port 106.

The pressurized fluid received at the second port 108 flows through the cross holes 109A, 109B and through the cross holes 111A, 111B to the chamber 120 in the piston 110. The pressurized fluid then applies a force on annular surface 148 of the poppet 116, thereby pushing the poppet 116 in the distal direction against action of the spring 126, which applies a force on the poppet 116 in the proximal direction via the collar 124 and the wire 130. Once the force applied by the fluid in the chamber 120 on the annular surface 148 of the poppet 116 overcomes the force of the spring 126, the poppet 116 moves or is displaced in the distal direction off the poppet seat 118.

As a result of displacement of the poppet 116, a gap or flow area is formed between the piston 110 and the poppet 116. As a result, the fluid received at the second port 108 flows through the flow area formed between the piston 110 and the poppet 116 to the first port 106.

The counterbalance valve 100 can also operate in a second mode of operation that can be referred to as the pilot modulation mode of operation. In this mode of operation, when a pilot pressure fluid signal received at the pilot port 132 along with the fluid received at the first port 106 overcome the pressure setting of the counterbalance valve 100, the counterbalance valve 100 opens and fluid is allowed from the first port 106 to the second port 108.

As depicted in FIG. 1, the counterbalance valve 100 is characterized by three areas $A_1$, $A_2$, and $A_3$. $A_l$ represents a circular area having a diameter of the poppet seat 118. $A_2$ represents a circular area of an exterior surface of the piston 110 at its distal end (i.e., circular area having outer diameter of the piston 110 proximate its distal end). $A_3$ represents a circular area of an exterior surface of the flanged portion 114 (i.e., circular area having outer diameter of the flanged portion 114). As depicted in FIG. 1, $A_3>A_2>A_1$.

Pressurized fluid received at the first port 106 applies a force in the proximal direction on a face of the poppet 116 having area $A_2$, and this force is transferred to the piston 110 interfacing with the poppet 116 at the poppet seat 118. The pressurized fluid also applies a force in the proximal direction on the piston 110, particularly on an area=$A_2-A_1$. Further, the pilot pressure fluid signal received at the pilot port 132 is communicated to the annular area 138 via the cross hole 134 and the cross hole 136 and applies a force in the proximal direction on the distal surface of the flanged portion 114 of the piston 110. The forces from both the pressurized fluid received at the first port 106 and the pilot pressure fluid signal thus act on the poppet 116 and the piston 110 in the proximal direction. When these forces overcome the force of the setting spring 140 on the piston 110, the poppet 116 and the piston 110 move or are displaced in the proximal direction (e.g., to the left in FIG. 1).

As the poppet 116 move in the proximal direction, the poppet 116 traverses a gap between the proximal end of the poppet 116 and the distal end of the pin 142. The poppet 116 may then contact the pin 142 and thereby stops moving. While the poppet 116 stops moving, the piston 110 may keep moving as the force of the pressurized fluid received at the first port 106 acting on the area $A_2-A_1$ combined with the force of the pilot pressure fluid signal acting on the flanged portion 114 overcome the force of the setting spring 140 on the piston 110. Because the poppet 116 stops moving, whereas the piston 110 continues to move in the proximal direction, a gap or flow area is formed between the piston 110 and the poppet 116. As a result, the fluid received at the first port 106 flows through the flow area formed between the piston 110 and the poppet 116, then through the chamber 120, the cross holes 111A, 111B and the cross holes 109A, 109B to the second port 108.

The counterbalance valve 100 is characterized by two parameters: the pressure setting $P_{CBV}$ and the pilot ratio $P_R$. The pressure setting $P_{CBV}$ can also be referred to as the crack pressure of the counterbalance valve 100 and is determined as $$P_{CBV} = \frac{F_{CBV}}{A_2 - A_1}$$

where $F_{CBV}$ is the force applied by the setting spring 140 on the piston 110 in the distal direction. The pilot ratio $P_R$ is determined as $$P_R = \frac{A_3 - A_2}{A_2 - A_1}.$$

The pilot ratio $P_R$ determines how the pressure setting of the counterbalance valve 100 changes as the pilot pressure (i.e., the pressure level of the pilot pressure fluid signal at the pilot port 132) changes. As an example, a 3:1 pilot ratio indicates that an increase of, for example, 10 bar in the pilot pressure decreases the pressure setting by 30 bar.

With this configuration, the force that the pilot pressure fluid signal applies to the piston 110 assists the pressurized fluid received at the first port 106 in overcoming the force applied to the piston 110 in the distal direction by the setting spring 140. In other words, the force that the pressurized fluid received at the first port 106 needs to apply to the piston 110 to cause the piston 110 to move axially in the proximal direction is reduced to a predetermined force value that is based on the pressure level of the pilot pressure fluid signal. As such, the force resulting from the pilot pressure fluid signal received at the pilot port 132 effectively reduces the pressure setting $P_{CBV}$ of the counterbalance valve 100, and thus a reduced pressure level at the first port 106 can cause the counterbalance valve 100 to open.

The two parameters $P_{CBV}$ and $P_R$ are dependent on geometry of the counterbalance valve 100 and are thus fixed. In other words, the two parameters $P_{CBV}$ and $P_R$ do not change during operation of a hydraulic system that includes the counterbalance valve 100.

Figure 2:
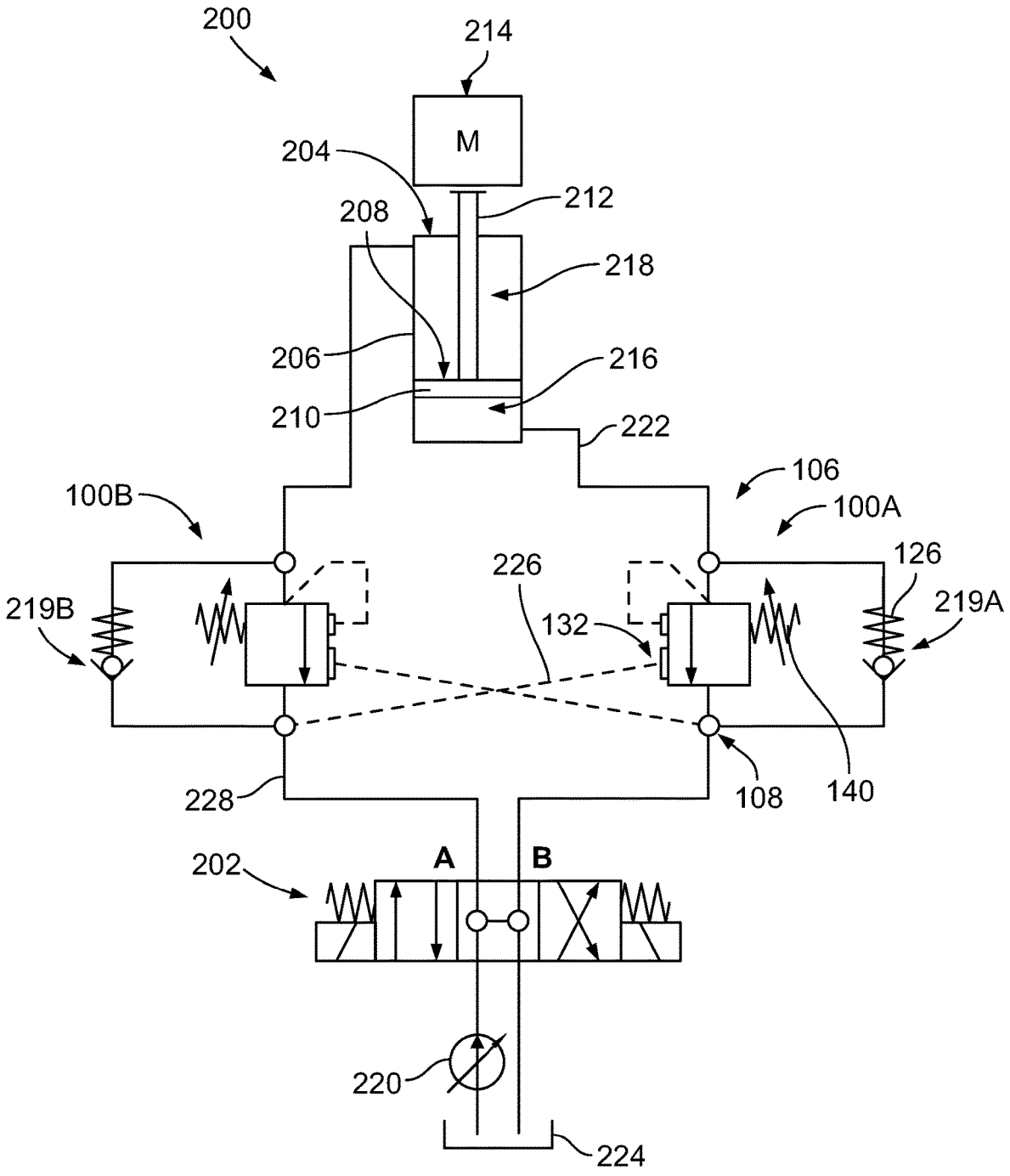
FIG. 2 illustrates a hydraulic system, in accordance with an example implementation.

FIG. 2 illustrates a hydraulic system 200, in accordance with an example implementation. The hydraulic system 200 includes a directional control valve 202 configured to control flow to and from an actuator 204. The actuator 204 includes a cylinder 206 and a piston 208 slidably accommodated in the cylinder 206. The piston 208 includes a piston head 210 and a rod 212 extending from the piston head 210 along a central longitudinal axis direction of the cylinder 206. The rod 212 is coupled to a load 214. The piston head 210 divides the inside of the cylinder 206 into a first chamber 216 and a second chamber 218.

The hydraulic system 200 further includes two counterbalance valves 100A, 100B symbolically or schematically represented in FIG. 2 and are similar to the counterbalance valve 100. The counterbalance valves 100A, 100B have the same components of the counterbalance valve 100. Therefore, the components or elements of counterbalance valves 100A, 100B are designated with the same reference numbers used for the counterbalance valve 100 in FIG. 1.

The counterbalance valves 100A, 100B include respective check valves 219A, 219B. The check valves 219A, 219B are depicted in FIG. 2 with a symbolic representation of the counterbalance valve 100 operating in the first mode of operation (e.g., reverse flow from the second port 108 to the first port 106) described above.

In an example operation, the load 214 can be a negative load that acts with gravity. In this example operation, the direction control valve 202 directs fluid flow received from a source of pressurized fluid, such as a pump 220, through the check valve 219B of the counterbalance valve 100B, to the second chamber 218 to lower the load 214. Without the counterbalance valve 100A, the weight of the load 214 can force fluid out of the first chamber 216 causing the load to drop uncontrollably. Further, without the counterbalance valve 100A, flow from the pump 220 might not be able to keep up with movement of the piston 208, causing cavitation in the second chamber 218.

To avoid uncontrollable lowering of the load 214 and cavitation in the second chamber 218, the counterbalance valve 100A is installed in a hydraulic line 222 leading from the first chamber 216 to the directional control valve 202. Particularly, the first port 106 of the counterbalance valve 100A is fluidly coupled to the first chamber 216, whereas the second port 108 of the counterbalance valve 100A is fluidly coupled to the directional control valve 202. The counterbalance valve 100A is configured to control or restrict fluid forced out of the first chamber 216 and received at the first port 106. Fluid exiting the counterbalance valve 100A through the second port 108 then flows through the direction control valve 202 to a reservoir or tank 224. The tank 224 can, for example, be configured to contain fluid at a low pressure level, e.g., atmospheric pressure level such as zero pounds per square inch (psi) or slightly higher (e.g., 70 psi).

A pilot line 226, tapped from a hydraulic line 228 connecting the directional control valve 202 to the counterbalance valve 100B, is fluidly coupled to the pilot port 132 of the counterbalance valve 100A. A pilot pressure fluid signal received through the pilot line 226 acts together with the pressure induced in the first chamber 216 and the hydraulic line 222 due to the load 214 against a force generated by the setting spring 140 of the counterbalance valve 100A as described above with respect to the second mode of operation (pilot modulation mode of operation) of the counterbalance valve 100. The combined action of the pilot pressure fluid signal and the induced pressure in the first chamber 216 facilitates opening the counterbalance valve 100A to allow flow therethrough from the first port 106 to the second port 108.

As described above, because the pilot pressure fluid signal acts against the setting spring 140, the pilot pressure fluid signal effectively reduces the pressure setting determined by a spring rate of the setting spring 140. The extent of reduction in the pressure setting is determined by the pilot ratio $P_R$. For example, if the pilot ratio $P_R$ is 3 to 1 (3:1), then for each 10 bar increase in pressure level of the pilot pressure fluid signal, the pressure setting of the setting spring 140 is reduced by 30 bar. As another example, if the pilot ratio is 8 to 1 (8:1), then for each 10 bar increase in the pressure level of pilot pressure fluid signal, the pressure setting of the setting spring 140 is reduced by 80 bar.

If the piston 208 tends to increase its speed, pressure level in the second chamber 218, the hydraulic line 228, and the pilot line 226 may decrease. As a result, the combined force acting against the setting spring 140 is decreased, and the flow area formed between the poppet 116 and the piston 110 is reduced. Thus, the counterbalance valve 100A restricts fluid flow therethrough and precludes the load 214 from dropping at large speeds (i.e., precludes the load 214 and the actuator 204 from overrunning).

The counterbalance valve 100B operates similar to the counterbalance valve 100A and is configured to control fluid flow forced out of the second chamber 218 when the piston 208 is extending. When the piston 208 is extending, the counterbalance valve 100A is configured to allow fluid flow through the check valve 219A from the directional control valve 202 to the first chamber 216.

As mentioned above, in examples, the pressure setting determined by the spring rate of the setting spring 140 can be selected such that the counterbalance valve 100A is configured to hold a maximum expected load. For example, if a diameter of the piston head 210 is 40 millimeter (mm) and a diameter of the rod 212 is 28 mm, then an annular area of the piston 208 (e.g., surface area of the piston head 210 minus a cross-sectional area of the rod 212) is equal to 640.56 millimeter squared. Thus, for an example maximum value of the load 214 being 10 kilo Newton (kN), the maximum induced pressure in the first chamber 216 can be estimated as the maximum force divided by the annular area and is thus equal to about 156 bar.

The setting spring 140 is selected to cause the counterbalance valve 100A to have a pressure setting that is higher than the maximum induced pressure so as to be able to hold the load 214. For example, the setting spring 140 may be selected to cause the counterbalance valve 100A to have a pressure setting of 210 bar.

As such, to open the counterbalance valve 100A and allow flow therethrough, the pilot pressure fluid signal received at the pilot port 132 from the hydraulic line 228 and the pilot line 226 and the induced pressure in the first chamber 216 apply respective forces within the counterbalance valve 100A that overcome the force caused by the setting spring 140. This configuration may render the hydraulic system 200 inefficient.

Particularly, in some cases, the load 214 might not be an overrunning load (i.e., the load 214 may be a positive load), and thus the induced pressure in the second chamber 218 may be low. In these cases, to open the counterbalance valve 100A, a high pilot pressure needs to be generated in the hydraulic line 228 to be tapped therefrom and communicated through the pilot line 226 to the pilot port 132 of the counterbalance valve 100A. In other words, the pressure level in the hydraulic line 228 rises to provide the high pilot pressure needed to open the counterbalance valve 100A when the load 214 is not an overrunning load.

Fluid power is estimated by a multiplication of pressure level and flow rate through the hydraulic system, and therefore an increased pressure level in the hydraulic line 228 causes an increase in power loss. If pressure level in the hydraulic line 228 is decreased, then the power that the pump 220 consumes to generate the fluid having sufficient power to operate the actuator 204 is also decreased and the hydraulic system 200 may operate more efficiently.

Therefore, it may be desirable to configure the hydraulic system 200 counterbalance valve 100A such that the pilot pressure fluid signal is received from an independent source, rather than from the hydraulic line 228. In other words, it may be desirable to decouple the source of the pilot pressure fluid signal provided to the pilot port 132 of the counterbalance valve 100A from the hydraulic line 228 that provides supply fluid flow to the actuator 204. This way, raising the pressure level of the pilot pressure fluid signal does not cause the pressure level in the hydraulic line 228 to increase. Disclosed herein are hydraulic systems configured to have an independent source of pressurized fluid for the pilot pressure fluid signal.

Figure 3:
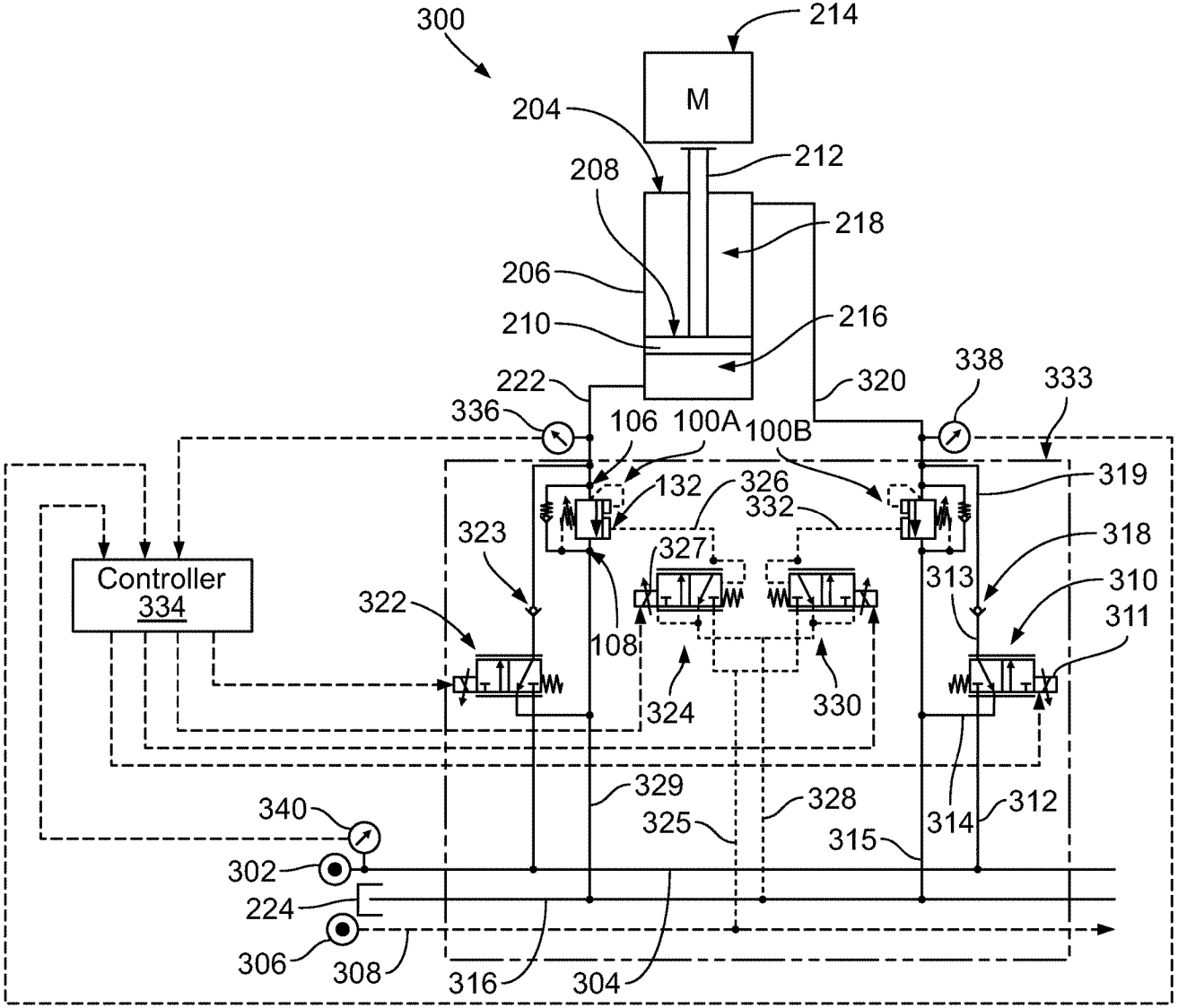
FIG. 3 illustrates a hydraulic system with an independent source of pressurized fluid for a pilot pressure fluid signal of a counterbalance valve, in accordance with an example implementation.

FIG. 3 illustrates a hydraulic system 300 with an independent source of pressurized fluid for a pilot pressure fluid signal of a counterbalance valve, in accordance with an example implementation. Similar components between the hydraulic system 300 and the hydraulic system 200 are designated with the same reference numbers.

The hydraulic system 300 includes a first source 302 of pressurized fluid configured to provide a supply of pressurized fluid to a supply line 304. The first source 302 of pressurized fluid can, for example, be a pump configured to receive fluid from the tank 224, pressurizes the fluid, and then provide the pressurized fluid to the supply line 304. Such pump can be fixed displacement pump, a variable displacement pump, or a load-sensing variable displacement pump, as examples.

The first source 302 of pressurized fluid can be configured to provide main flow to the actuator 204 (e.g., the flow that causes the piston 208 to move) and other actuators of a machine. As such, the first source 302 of pressurized fluid can be configured to provide a large flow rate, e.g., 25-100 gallons per minute (GPM). The first source 302 of pressurized fluid can be configured to have a low standby pressure (e.g., 200 psi). When the actuators (e.g., the actuator 204) of the machine are actuated, the first source 302 of pressurized fluid can provide fluid flow at high pressure levels, e.g., 4000-6000 psi to operate the various actuators of the machine.

The hydraulic system 300 also includes a second source 306 of pressurized fluid configured to provide pilot fluid to pilot fluid line 308. The second source 306 of pressurized fluid can be another pump or an accumulator or other source of pressurized fluid (e.g., output of another valve). For instance, the second source 306 of pressurized fluid can be a charge pump separate from the first source 302 of pressurized fluid. Because the second source 306 of pressurized fluid provides pilot fluid, the amount of flow resulting from the second source 306 of pressurized fluid can be small, e.g., less than 1 GPM, compared to the main flow supplied by the first source 302 of pressurized fluid to operate the actuator 204 (and other actuators of a machine). In an example, a hydraulic line or passage can be tapped from the supply line 304 and connected to the pilot fluid line 308 so as to provide pilot fluid from the first source 302 of pressurized fluid through such hydraulic line or passage to the pilot fluid line 308.

The hydraulic system 300 includes a first meter-in valve 310 configured to fluidly couple the supply line 304 to the second chamber 218 of the actuator 204. The meter-in valve 310 can, for example, be a proportional valve that is electronically controlled via a solenoid 311.

As a particular example, the meter-in valve 310 can be a 3-way, electro-proportional throttle valve. When the solenoid 311 is un-energized, the meter-in valve 310 blocks fluid flow from hydraulic line 312 coupled to the supply line 304, but allows fluid in a hydraulic line 313 to drain to the tank 224 through hydraulic lines 314, 315 and return line 316.

When the solenoid 311 is energized, the solenoid 311 can generate a closing force on a spool of the meter-in valve 310, creating a metering orifice between the hydraulic line 312 and the hydraulic line 313, where a size of the metering orifice is proportional to the command current or signal to the solenoid 311. Fluid exiting the meter-in valve 310 then flows through a check valve 318 and hydraulic lines 319 and 320 to the second chamber 218 to retract the piston 208. This configuration of the meter-in valve 310 is an example for illustration, and other configurations could be used. For example, the meter-in valve 310 can be 2-way proportional valve, rather than 3-way. Also, the meter-in valve 310 and can be a poppet valve rather than a spool valve. Thus, the meter-in valve 310 can be any type of valve that can be electronically controlled to meter fluid flow from the supply line 304 to the second chamber 218.

The hydraulic system 300 can also include a second meter-in valve 322 and a check valve 323 that can be configured similar to the meter-in valve 310 and the check valve 318, respectively, and can be configured to control fluid flow from the supply line 304 to the first chamber 216 to extend the piston 208.

The hydraulic system 300, similar to the hydraulic system 200, includes the counterbalance valves 100A, 100B to control flow of fluid discharged from the actuator 204. Particularly, the counterbalance valve 100A controls flow of fluid discharged from the first chamber 216, whereas the counterbalance valve 100B controls flow of fluid discharged from the second chamber 218. As shown in FIG. 3, the counterbalance valves 100A, 100B are directly connected to the return line 316, and thus the fluid exiting the counterbalance valves 100A, 100B flows directly to the return line 316, as opposed to flowing through a directional control valve (e.g., the directional control valve 202) as shown in FIG. 2 before reaching the tank 224. With this configuration, the counterbalance valves 100A, 100B are configured as meter-out valves and the hydraulic system 300 can avoid power loss resulting from the fluid discharged from the actuator 204 flowing through the directional control valve.

Further, the hydraulic system 300 differs from the hydraulic system 200 in that the pilot pressure fluid signal is not derived from a cross-over hydraulic line supplying fluid to a meter-in valve. Rather, the pilot fluid signal is derived from the second source 306 of pressurized fluid.

Particularly, the hydraulic system 300 includes a first pressure reducing valve 324 disposed downstream from the second source 306 of pressurized fluid and configured to fluidly couple the second source 306 of pressurized fluid to the pilot port 132 of the counterbalance valve 100A. A hydraulic line 325 fluidly couples the pilot fluid line 308 to an inlet port of the pressure reducing valve 324, and a hydraulic line 326 fluidly couples an outlet port of the pressure reducing valve 324 to the pilot port 132 of the counterbalance valve 100A.

As an example for illustration, the pressure reducing valve 324 can be configured as an electro-proportional, reducer/reliever valve having a solenoid 327. When the solenoid 327 is un-energized, the pilot port 132 is drained to the tank 224 by being connected to the return line 316 through hydraulic line 328. Energizing the solenoid 327 connects the inlet port, which is fluidly coupled to the hydraulic line 325, to the hydraulic line 326 coupled to the pilot port 132. When the solenoid 327 is energized, the pressure reducing valve 324 operates to receive fluid having a first pressure level through the hydraulic line 325 from the pilot fluid line 308 and reduce the pressure level to a second pressure level that is proportional to a current command to the solenoid 327. Increasing the current to the solenoid 327 can proportionally increase the reduced pressure level at the outlet port of the pressure reducing valve 324 connected to the pilot port 132. If pressure level at the outlet port of the pressure reducing valve 324 exceeds the setting induced by the solenoid 327, pressure at the outlet port is relieved.

As an example for illustration, the second source 306 of pressurized fluid can be configured to provide fluid having a pressure level of about 800 psi. The pressure reducing valve 324 can be configured to then reduce the pressure level of the fluid from 800 psi to a pressure level between 200 psi and 600 psi that is proportional to the current command to the solenoid 327. The pilot pressure fluid signal provided to the counterbalance valve 100A from the hydraulic line 326 to the pilot port 132 along with the load pressure at the first port 106 of the counterbalance valve 100A may cause the counterbalance valve 100A to open, thereby metering fluid discharged from the first chamber 216 through the counterbalance valve 100A. Fluid then flows through hydraulic line 329 to the return line 316, which communicates the fluid to the tank 224.

With this configuration, the pilot pressure fluid signal provided to the counterbalance valve 100A is derived from the second source 306 of pressurized fluid, which is independent and decoupled from the hydraulic line 312 that provides supply fluid through the meter-in valve 310 to the second chamber 218. Thus, if a pilot pressure fluid signal having a high pressure is needed to open the counterbalance valve 100A under some operating conditions, the pressure level of the fluid in the hydraulic line 312 might not be raised to a high level, but is rather independent from the pressure level of the pilot pressure fluid signal. In other words, if a pilot pressure fluid signal having a high pressure is needed to open the counterbalance valve 100A under some operating conditions, the current command to the solenoid 327 can be varied to increase the pressure level being output from the pressure reducing valve 324 without affecting the pressure level of the main flow in the hydraulic line 312 going to the meter-in valve 310. This way, the hydraulic system 300 can be more efficient than the hydraulic system 200 in which raising the pressure level of the pilot pressure fluid signal in the pilot line 226 can cause the pressure level in the hydraulic line 228 to increase, thereby causing an increase in power loss in the hydraulic system 200.

The hydraulic system 300 further includes a second pressure reducing valve 330 that is similar to the first pressure reducing valve 324. The second pressure reducing valve 330 is fluidly coupled via the hydraulic line 325 to the pilot fluid line 308 and is fluidly coupled to the pilot port of the counterbalance valve 100B through hydraulic line 332. The second pressure reducing valve 330 operates in a manner similar to the first pressure reducing valve 324. The meter-in valve 310, the counterbalance valve 100A, and the first pressure reducing valve 324 control retraction of the piston 208, whereas the meter-in valve 322, the counterbalance valve 100B, and the second pressure reducing valve 330 control extension of the piston 208.

In examples, the meter-in valves 310, 322, the counterbalance valves 100A, 100B, and the pressure reducing valves 324, 330 can be referred to as a valve assembly 333. The valve assembly 333 can, for example, represents a manifold or block that has several cavities to house the meter-in valves 310, 322, the counterbalance valves 100A, 100B, and the pressure reducing valves 324, 330 and includes hydraulic passages and holes that form the hydraulic lines and connections between the valves and between the vales and other components of the hydraulic system 300.

The hydraulic system 300 includes a controller 334 that can comprise any type of computing device configured to control operation of the hydraulic system 300. The controller 334 may include one or more processors or microprocessors and may include data storage (e.g., memory, transitory computer-readable medium, non-transitory computer-readable medium, etc.). The data storage may have stored thereon instructions that, when executed by the one or more processors of the controller 334, cause the controller 334 to perform the operations described herein.

The hydraulic system 300 may include one or more pressure sensors such as pressure sensor 336 configured to measure pressure level in the first chamber 216 and pressure sensor 338 configured to measure pressure level in the second chamber 218. The hydraulic system 300 can also include pressure sensor 340 configured to measure pressure level of pressurized fluid discharged from the first source 302 of pressurized fluid. The pressure sensors 336, 338, 340 are in communication with the controller 334 and provide to the controller 334 information indicative of the pressure levels respectively measured by the pressure sensors 336, 338, 340. The controller 334 can then determine the load 214 based on the pressure levels in the chambers 216, 218 and the surface areas of the piston 208 in each chamber.

The hydraulic system 300 may additionally or alternatively include a load sensor (e.g., a load cell) configured to measure the load 214. Further, in some examples, the hydraulic system 300 can include one of the pressure sensors 336, 338, such as the pressure sensor 336 configured to measure the pressure level in the first chamber 216. Other types of sensors could be used to indicate the magnitude of the load 214.

In operation, to extend the piston 208, the controller 334 actuates the meter-in valve 322 and the pressure reducing valve 330. As such, pressurized fluid is provided from the first source 302 of pressurized fluid through the meter-in valve 322 and the check valve 323 to the first chamber 216. As the piston 208 extends, fluid forced out of the second chamber 218 flows through the hydraulic line 320 and the counterbalance valve 100B, then through the hydraulic line 315 and the return line 316, to the tank 224. The controller 334 thus provides a current command to the meter-in valve 322 so as to cause an orifice formed within the meter-in valve 322 to have a particular size allowing a corresponding amount of flow to achieve a particular velocity for the piston 208. Further, the controller 334 provides a current command to the pressure reducing valve 330 to generate a pilot pressure fluid signal for the counterbalance valve 100B. The current command is determined by the controller 334 to generate a pilot pressure fluid signal having a particular pressure level based on the load 214.

To retract the piston 208, the controller 334 actuates the meter-in valve 310 and the pressure reducing valve 324. As such, pressurized fluid is provided from the first source 302 of pressurized fluid through the meter-in valve 310 and the check valve 318 to the second chamber 218. As the piston 208 retracts, fluid in the first chamber 216 is forced out of the first chamber 216 through the hydraulic line 222 to the first port 106 of the counterbalance valve 100A. Further, a pilot pressure fluid signal is received through the hydraulic line 326 from the pressure reducing valve 324 at the pilot port 132.

The pilot pressure fluid signal received through the hydraulic line 326 at the pilot port 132 acts on the piston 110 of the counterbalance valve 100A as described above with respect to FIG. 1. The pilot pressure fluid signal along with the fluid received at the first port 106 act against the setting spring 140. Once the combined action of the pilot pressure fluid signal received at the pilot port 132 and the fluid at the first port 106 overcome the pressure setting of the counterbalance valve 100A, the counterbalance valve 100A can open to allow fluid at the first port 106 to flow to the second port 108, then through the hydraulic line 329 to the return line 316 and then to the tank 224. The controller 334 thus provides a current command to the solenoid 311 of the meter-in valve 310 so as to cause an orifice formed within the meter-in valve 310 to have a particular size allowing a corresponding amount of flow to achieve a particular velocity for the piston 208. Further, the controller 334 provides a current command to the solenoid 327 of the pressure reducing valve 324 to generate a pilot pressure fluid signal for the counterbalance valve 100A. The current command is determined by the controller 334 to generate a pilot pressure fluid signal having a particular pressure level based on the load 214.

Additionally, the controller 334 may vary, adjust, or modify the pressure level of the pilot pressure fluid signal generated by the pressure reducing valve 324 by varying a magnitude of the current command to the solenoid 327 of the pressure reducing valve 324 when the piston is retracting. In this manner, the controller 334 may monitor the load 214 through the information received from the pressure sensors 336, 338 or any other sensors to determine whether the load 214 is acting with gravity and inducing a large pressure in the first chamber 216 and the extent or value of the induced pressure in the first chamber 216 or whether the load 214 is a positive or resistive load. Accordingly, the controller 334 can send a signal to the solenoid 327 to vary the pressure level of the pilot pressure fluid signal generated by the pressure reducing valve 324.

For example, if the load 214 is large and acting with gravity, then the controller 334 might send a current command to the solenoid 327 that causes a pressure level of the pilot pressure fluid signal generated by the pressure reducing valve 324 to be low. This way, the piston 110 might not move a large axial distance, and the counterbalance valve 100A restricts flow to control lowering the load 214.

On the other hand, if the load 214 is small or the actuator 204 is tilted at an angle such that gravitational force is reduced or the load becomes a positive resistive load, the controller 334 can provide a current command that generates a pilot pressure fluid signal having a high pressure level. This way, the pressure level in the first chamber 216 that causes the counterbalance valve 100A to open is reduced. Further, the pressure level of the pilot pressure fluid signal controlled by the second source 306 of pressurized fluid and the pressure reducing valve 324 is independent of and decoupled from the pressure level of the supply fluid flow provided from the first source 302 of pressurized fluid to the meter-in valve 310. As such, increasing the pressure level of the pilot pressure fluid signal by controlling the pressure reducing valve 324 fluid coupled to the second source 306 of pressurized fluid does not affect or raise the pressure level in the hydraulic line 312. As a result, the hydraulic system 300 operates more efficiently and energy loss can be reduced.

The operations described with respect to retracting the piston 208 can also be implemented similarly when the piston 208 is extending, and the controller 334 can also similarly vary, adjust, or modify the pressure level of the pilot pressure fluid signal generated by the pressure reducing valve 330 when the piston 208 is extending based on the magnitude of the load 214.

Several control methodologies could be implemented by the controller 334 to determine the commands that the controller 334 provides to the meter-in valve 310 and the pressure reducing valve 324 if the piston 208 is to be retracted or to the meter-in valve 322 and the pressure reducing valve 330 if the piston 208 is to be extended. In the following example description of a control methodology, it is assumed that the piston 208 is to be extended; however, a similar methodology can be applied to retract the piston 208.

The equations below use the following symbols: $u_{in}$ represents command provided by the controller 334 to the meter-in valve 322; $\Delta p_{in}$ represents pressure change or drop across the meter-in valve 322 (i.e., the change in pressure level of the fluid provided from the supply line 304 as the fluid flows through the meter-in valve 322); $u_{out}$ represents command provided by the controller 334 to the pressure reducing valve 330; $\Delta p_{out}$ represents pressure change or drop across the counterbalance valve 100B (i.e., the change in pressure level of the fluid discharged from the second chamber 218 as the fluid flows through the counterbalance valve 100B); $F_L$ represents the load 214; $A_A$ represents surface area of the piston head 210 exposed in the first chamber 216; $A_a$ represents surface area of the annular area equal to the surface area ($A_A$) of piston head 210 minus a cross sectional area of the rod 212; $Q_{in}$ represents flow rate of fluid flowing through the meter-in valve 322 to the first chamber 216; $Q_{out}$ represents flow rate of fluid flowing out of the second chamber 218 and through the counterbalance valve 100B; $p_A$ represents pressure level of the fluid in the first chamber 216 measured by the pressure sensor 336; $p_a$ represents pressure level of the fluid in the second chamber 218 measured by the pressure sensor 338; $p_p$ represents pressure level of the pressurized fluid provided by the first source 302 of pressurized fluid.

Using the orifice equation, the flow rate $Q_{in}$ through the meter-in valve 322 can be determined as:

$$Q_{in} = \alpha_D A(u_{in})\sqrt{\frac{2(p_P - p_A)}{\rho}} \tag{1}$$

where $\alpha_D$ is a parameter based on coefficient of discharge through an orifice, A is an area of the orifice formed within the meter-in valve 322 through which the fluid flows, and ρ is the density of the fluid.

From equation (1), the command $u_{in}$ to the meter-in valve 322 that would allow for a particular flow rate $Q_{in}$ that achieves a particular velocity for the piston 208 can be determined as:

$$u_{in} = A^{-1}\left[\frac{Q_{in}}{\alpha_D}\sqrt{\frac{\rho}{2(p_P - p_A)}}\right] \tag{2}$$

The controller 334 can provide the command $u_{out}$ to the pressure reducing valve 330 based on the load $F_L$, which can be determined as:

$$F_L = p_a A_a - p_A A_A \tag{3}$$

If the load $F_L$ is a positive, resistive load, then the counterbalance valve 100B can be commanded to be fully open. In other words, the command $u_{out}$ provided to the pressure reducing valve 330 is such that it causes the pilot pressure fluid signal generated therefrom to have a high pressure level that causes the piston 110 of the counterbalance valve 100 to be shifted by a large axial distance (e.g., full shift) to allow fluid flow across the counterbalance valve 100B with minimal restriction or pressure drop thereacross.

If, on the other hand, the load $F_L$, is a negative (e.g., overrunning load), then the controller 334 provides a command $u_{out}$ to the pressure reducing valve 330 that causes the counterbalance valve 100B to restrict fluid flow therethrough to extend the load 214 controllably. In an example, the command $u_{out}$ can be determined to cause the counterbalance valve 100B to open while reducing (e.g., minimizing) pressure drop and thus power loss across the counterbalance valve 100B. The power loss $W_{CBV}$ across the counterbalance valve 100B can be determined as:

$$W_{CBV} = \Delta p_{out} Q_{out} = (p_a - p_T) Q_{out} \tag{5}$$

where $p_L$ is pressure level in the return line 316 and can be measured by another pressure sensor or can be assumed to have a particular value such as zero psi, 70 psi, 100 psi, or another value. When the counterbalance valve 100B is opened and fluid is allowed to flow from the first port 106 to the second port 108, the flow area formed between the piston 110 and the poppet 116 operates as an orifice having an area $A_{CBV}$ through which fluid flows. Using the orifice equation, the power loss in equation (5) can be expressed as:

$$W_{CBV} = (p_a - p_T)\alpha_D A_{CBV}(u_{out})\sqrt{\frac{2(p_a - p_T)}{\rho}} \tag{6}$$

Thus, $W_{CBV}$ can be expressed as:

$$W_{CBV} = \alpha_D A_{CBV}(u_{out})\sqrt{\frac{2(p_a - p_T)^3}{\rho}} \tag{7}$$

From equation (3), $p_a$ can be determined as:

$$p_a = \frac{|F_L| + p_A A_A}{A_a} \tag{8}$$

where $|F_L|$ is a magnitude of the load $F_L$. Replacing $p_a$ from equation (8) into equation (7):

$$W_{CBV} = \alpha_D A_{CBV}(u_{out})\sqrt{\frac{2\left(\frac{|F_L| + p_A A_A}{A_a} - p_T\right)^3}{\rho}} \quad (9)$$

Equation (9) expresses $W_{CBV}$ as a function of $p_A$ and $u_{out}$. In other words, $W_{CBV}=f(p_A,u_{out})$. The function $f(p_A,u_{out})$ can be considered as an objective function and the controller 334 can implement an optimization routine to determine a set of feasible values for $p_A$ and $u_{out}$ that minimizes or reduces the objective function $f(p_A,u_{out})$. The feasible values can be constrained to specific ranges. For instance, pressure level in the first chamber 216 $p_A$ can be constrained to have a value greater than or equal to a particular value $p_{A,min}$ so as to preclude cavitation in the first chamber 216. Also, the command $u_{out}$ can be constrained, for example, to have a value less than or equal to $$A_{CBV}^{-1}\left[\frac{A_a}{A_A}A(u_{in})\sqrt{\frac{p_P - p_A}{p_a - p_T}}\right].$$

An optimization problem can thus be expressed as a minimization (min) problem subject to (s.t.) constraints on the values of the variables $p_A$ and $u_{out}$. As an example, the optimization problem can be expresses by the following equation:

$$\min f(p_A, u_{out}) \quad (10)$$

$$\text{s.t. } p_A \geq p_{A,min}$$

$$u_{out} \leq A_{CBV}^{-1}\left[\frac{A_a}{A_A}A(u_{in})\sqrt{\frac{p_P - p_A}{p_a - p_T}}\right]$$

Such an optimization (or minimization problem) can be implemented or run by the controller 334 in real time to determine values for $p_A$ and $u_{out}$ that reduce power loss across the counterbalance valve 100B.

The mathematical expressions provided above are examples for illustration only and other variations could be implemented. Further, the hydraulic system 300 represents an example system configuration; however, other configurations could be implemented while similarly maintaining independence and decoupling of the pilot pressure fluid signal from the supply fluid in the supply line 304. Several variations could be implemented as described next.

Figure 4:
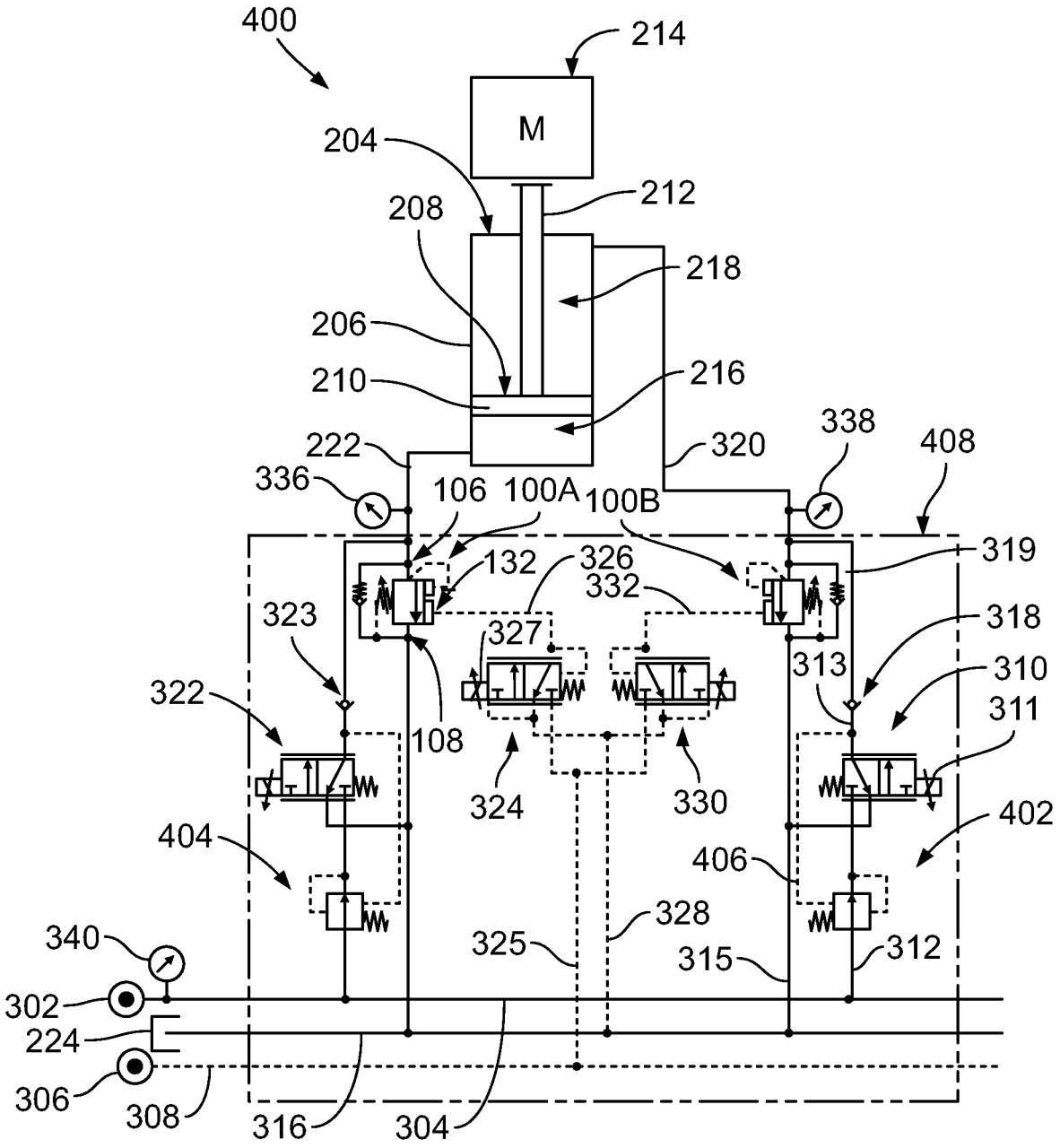
FIG. 4 illustrates a hydraulic system including pressure compensator valves, in accordance with an example implementation.

As an example variation, FIG. 4 illustrates a hydraulic system 400 including pressure compensator valves 402 and 404, in accordance with an example implementation. In FIG. 4, the controller 334 and associated signal lines are not shown to reduce visual clutter in the drawing.

As depicted in FIG. 4, the pressure compensator valve 402 is disposed in the hydraulic line 312 upstream from the meter-in valve 310 and downstream from the first source 302 of pressurized fluid and the supply line 304. In other words, the pressure compensator valve 402 is disposed between the first source 302 of pressurized fluid and the meter-in valve 310.

The pressure compensator valve 402 can be configured as a normally open valve that acts as a restrictive compensator to maintain a constant pressure drop across the meter-in valve 310, regardless of variations in upstream or downstream pressure level. For example, the pressure compensator valve 402 can include a pressure compensator spool that is configured to be subjected via hydraulic line 406 to a fluid signal having pressure level of the fluid in the hydraulic line 313 downstream from or exiting the meter-in valve 310. The pressure compensator spool is also configured to be subjected to fluid provided from the supply line 304. The pressure compensator spool can then move against the force of a spring or any other biasing device to maintain a predetermined pressure drop across the meter-in valve 310. The term "pressure drop" is used herein to indicate the pressure differential across the meter-in valve 310, i.e., the difference in pressure between fluid entering the meter-in valve 310 and fluid exiting the meter-in valve 310.

Particularly, the pressure compensator valve 402 changes pressure level of fluid exiting the pressure compensator valve 402 such that the pressure differential across the meter-in valve 310 remains substantially constant (e.g., equal to a spring rate of the spring of the pressure compensator valve 402). The term "substantially" in this regard indicates that the pressure drop or differential across the meter-in valve 310 remains within a threshold value (e.g., ±20 psi from) a particular pressure drop value (e.g., 200 psi). This way, the pressure compensator valve 402 regulates the fluid flow across the meter-in valve 310 such that a substantially constant flow rate can be achieved across the meter-in valve 310 for a given command from the controller 334 to the solenoid 311 (e.g., for a given axial position of a spool within the meter-in valve 310).

The hydraulic system 400 similarly includes the pressure compensator valve 404 disposed upstream from the meter-in valve 322 and downstream from the first source 302 of pressurized fluid and the supply line 304. In other words, the pressure compensator valve 404 is disposed between the first source 302 of pressurized fluid and the meter-in valve 322.

The pressure compensator valve 404 can be configured similar to the pressure compensator valve 402. As such, the pressure compensator valve 404 can be configured as a normally open valve that acts as a restrictive compensator to maintain a constant pressure drop across the meter-in valve 322, regardless of variations in upstream or downstream pressure level. For example, the pressure compensator valve 404 can include a pressure compensator spool that is configured to be subjected to a respective fluid signal having pressure level of the fluid in the downstream from or exiting the meter-in valve 322. The pressure compensator spool is also configured to be subjected to fluid provided from the supply line 304. The pressure compensator spool of the pressure compensator valve 404 may then move against the force of a spring or any other biasing device to maintain a predetermined pressure drop across the meter-in valve 322.

In examples, the meter-in valves 310, 322, the counterbalance valves 100A, 100B, the pressure reducing valves 324, 330, and the pressure compensator valve 402, 404 can be referred to as a valve assembly 408. The valve assembly 408 can, for example, represents a manifold or block that has several cavities to house the meter-in valves 310, 322, the counterbalance valves 100A, 100B, the pressure reducing valves 324, 330, and the pressure compensator valve 402, 404 and includes hydraulic passages and holes that form the hydraulic lines and connections between the valves and between the vales and other components of the hydraulic system 400.

Figure 5:
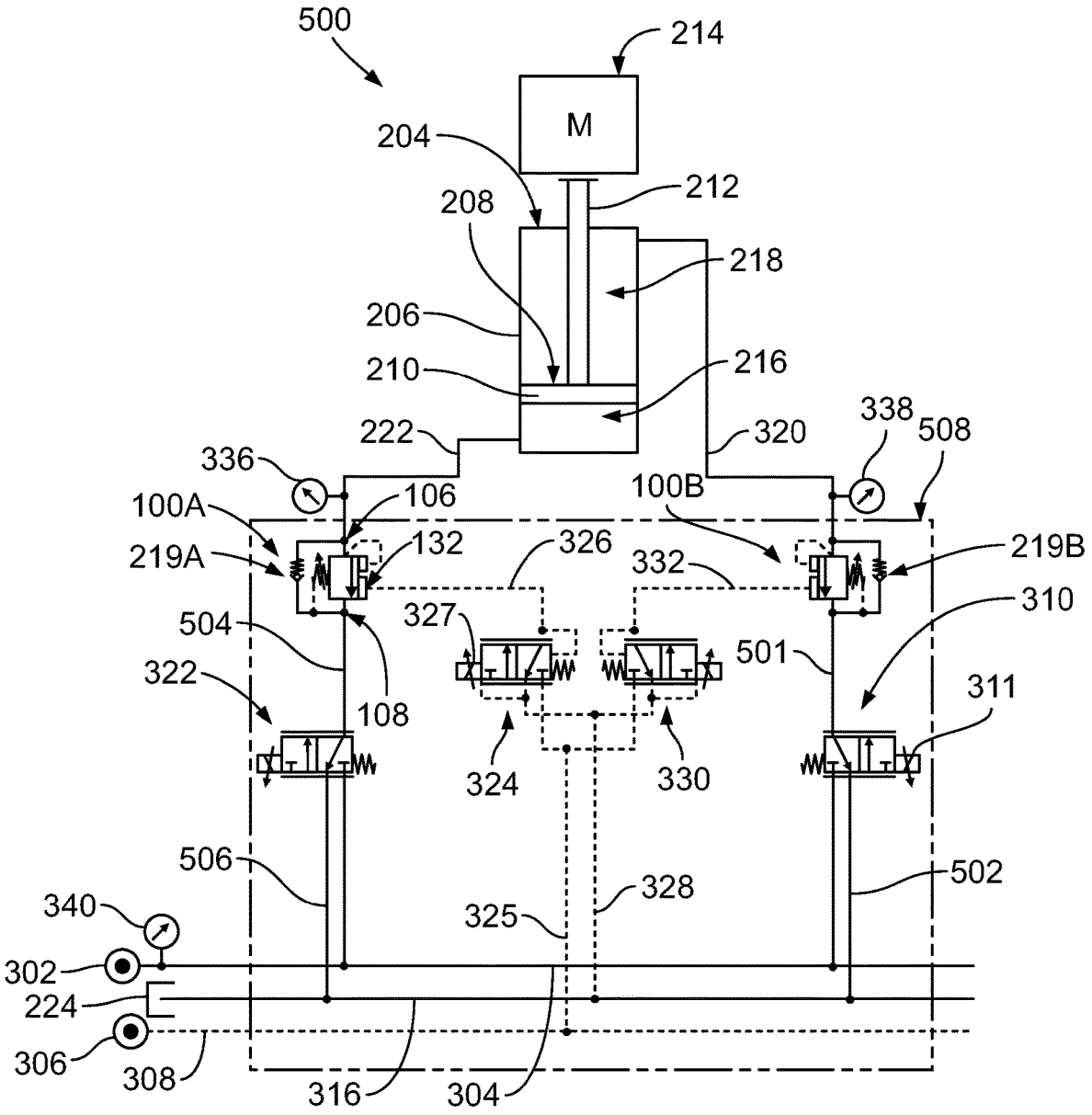
FIG. 5 illustrates a hydraulic system where fluid exiting a counterbalance valve flows through a corresponding a meter-in valve before returning to a tank, in accordance with an example implementation.

As another example variation, FIG. 5 illustrates a hydraulic system 500 where fluid exiting a counterbalance valve flows through a corresponding the meter-in valve before returning to the tank 224, in accordance with an example implementation. In FIG. 5, the controller 334 and associated signal lines are not shown to reduce visual clutter in the drawing.

The hydraulic system 500 represents a variation from the hydraulic system 300. Particularly, the check valves 318 and 323 are not used in the hydraulic system 500. Rather, when the meter-in valve 310 is actuated to provide flow from the supply line 304 to the second chamber 218 and retract the piston 208, the fluid exiting the meter-in valve 310 flows through the check valve 219B of the counterbalance valve 100B, then through the hydraulic line 320 to the second chamber 218. Similarly, when the meter-in valve 322 is actuated to provide flow from the supply line 304 to the first chamber 216 and extend the piston 208, the fluid exiting the meter-in valve 322 flows through the check valve 219A of the counterbalance valve 100A, then through the hydraulic line 222 to the first chamber 216.

Further, while in the hydraulic system 300 the counterbalance valves 100A, 100B are directly coupled to the return line 316 such that fluid flowing out of the second port 108 flows directly to the return line 316 without flowing through other valves, in the hydraulic system 500 the fluid exiting from the second port 108 flows through the corresponding meter-in valve before reaching the return line 316. For example, to extend the piston 208, the controller 334 can actuate the meter-in valve 322 to allow fluid flow from the supply line 304 through the meter-in valve 322, the check valve 219A, and the hydraulic line 222 to the first chamber 216. At the same time, the controller 334 can actuate the pressure reducing valve 330 to open the counterbalance valve 100B and allow fluid discharged from the second chamber 218 to flow therethrough to hydraulic line 501. The meter-in valve 310 is unactuated, and in the unactuated state schematically depicted in FIG. 5, the meter-in valve 310 fluidly couples the hydraulic line 501 to hydraulic line 502. As such, the fluid exiting the counterbalance valve 100B flows through the hydraulic line 501, then the meter-in valve 310 to the hydraulic line 502, and then to the return line 316.

Similarly, to retract the piston 208, the controller 334 can actuate the meter-in valve 310 to allow fluid flow from the supply line 304 through the meter-in valve 310, the check valve 219B, and the hydraulic line 320 to the second chamber 218. At the same time, the controller 334 can actuate the pressure reducing valve 324 to open the counterbalance valve 100A and allow fluid discharged from the first chamber 216 to flow therethrough to hydraulic line 504. The meter-in valve 322 is unactuated, and in the unactuated state schematically depicted in FIG. 5, the meter-in valve 322 fluidly couples the hydraulic line 504 to hydraulic line 506. As such, the fluid exiting the counterbalance valve 100A flows through the hydraulic line 504, then the meter-in valve 322 to the hydraulic line 506, and then to the return line 316.

In examples, the meter-in valves 310, 322, the counterbalance valves 100A, 100B, and the pressure reducing valves 324, 330 as depicted in FIG. 5 can be referred to as a valve assembly 508. The valve assembly 508 can, for example, represents a manifold or block that has several cavities to house the meter-in valves 310, 322, the counterbalance valves 100A, 100B, and the pressure reducing valves 324, 330 and includes hydraulic passages and holes that form the hydraulic lines and connections between the valves and between the vales and other components of the hydraulic system 500.

Figure 6:
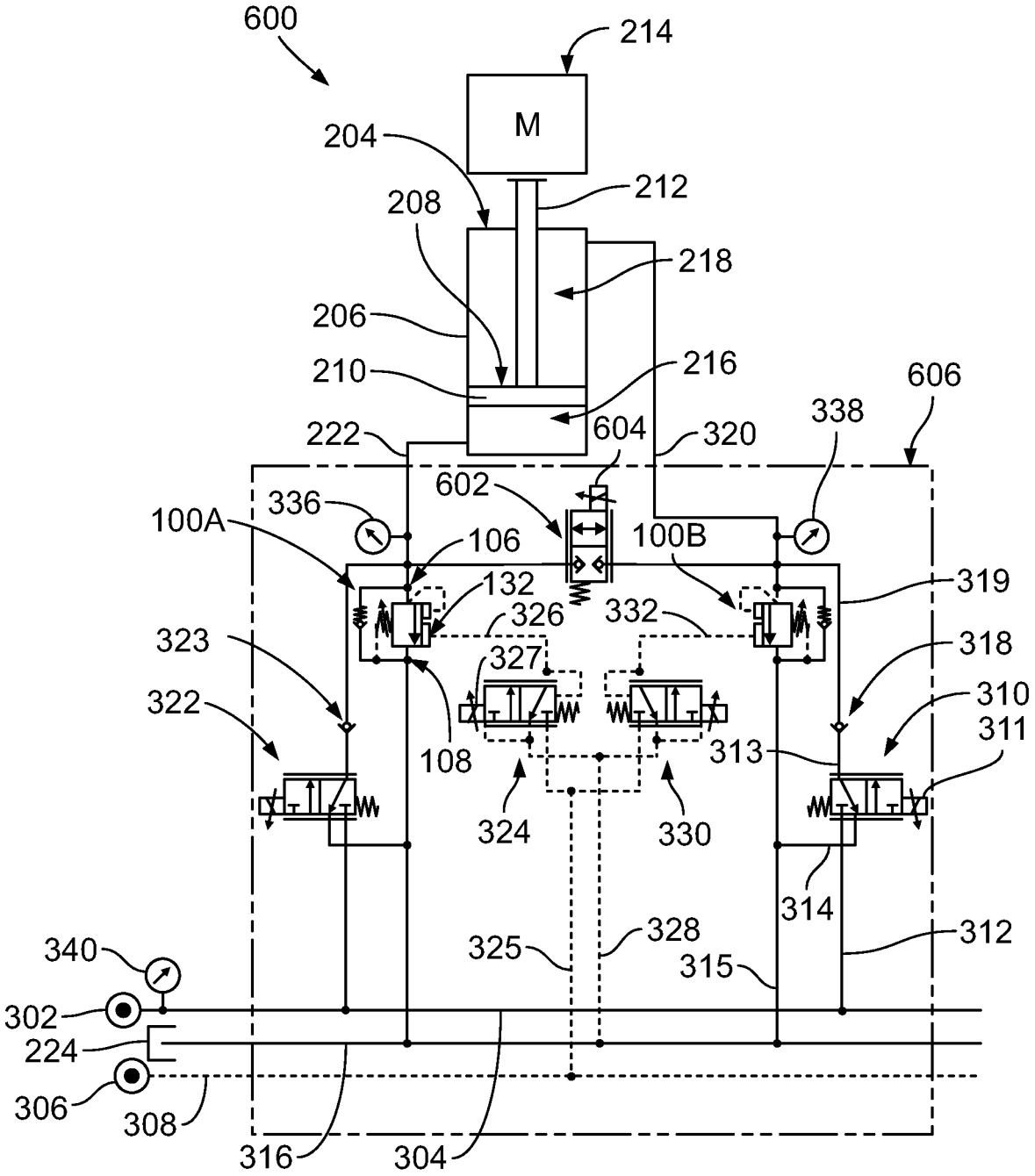
FIG. 6 illustrates a hydraulic system with a regeneration valve, in accordance with an example implementation.

In another example variation, FIG. 6 illustrates a hydraulic system 600 with a regeneration valve 602, in accordance with an example implementation. The controller 334 is configured to control actuation of the regeneration valve 602. For example, the regeneration valve can have a solenoid 604 such that when the controller 334 provides an electric signal (e.g., current command) to the solenoid 604, the regeneration valve 602 is actuated (e.g., opens). The regeneration valve can be a proportional valve (e.g., the amount of flow therethrough is proportional to the command) or can be an on-off valve (e.g., either fully open when actuated, or fully closed when not actuated). In FIG. 6, the controller 334 and associated signal lines are not shown to reduce visual clutter in the drawing.

When actuated, the regeneration valve 602 fluidly couples the hydraulic lines 222 and 320, and thus fluidly couples the first chamber 216 to the second chamber 218. The regeneration valve 602 can be configured to be a bi-directional valve, and as such allows flow from the first chamber 216 to the second chamber 218 and from the second chamber 218 to the first chamber 216.

To extend the piston 208, the controller 334 can actuate the meter-in valve 322. If the load 214 is negative (e.g., gravity assisted) or resistive but has a value $F_L$ that is less than a threshold force value (e.g., a threshold force value equal to a maximum pressure that can be supplied by the first source 302 of pressurized fluid multiplied by area difference $A_A-A_a$), then rather than actuating the pressure reducing valve 330 to open the counterbalance valve 100B, the controller 334 can actuate the regeneration valve 602. This way, fluid discharged from the second chamber 218 flows through the hydraulic line 320 and the regeneration valve 602 to join or be augmented with the fluid exiting the meter-in valve 322. The combined flow then flows into the first chamber 216. As such, the first source 302 of pressurized fluid can supply less amount of flow to achieve a particular velocity for the piston 208.

To retract the piston 208 while the load 214 is negative (e.g., gravity assisted), the controller 334 might not actuate the meter-in valve 310. Rather, the controller 334 can actuate the regeneration valve 602, such that fluid discharged from the first chamber 216 flows through the hydraulic line 222, the regeneration valve 602, and the hydraulic line 320 into the second chamber 218.

The flow rate of fluid discharged from the first chamber 216 is equal to $VA_A$, where V is a velocity of the piston 208. The flow rate of fluid entering the second chamber 218 is equal to $VA_a$. Therefore, for a particular velocity V of the piston 208, the amount of flow discharged from the first chamber 216 is larger than the amount of flow entering the second chamber 218 because $A_A>A_a$. As such, the controller 334 actuates the pressure reducing valve 330 so as to open the counterbalance valve 100B and allow a differential amount of flow equal to $V(A_A-A_a)$ to flow therethrough and then to the tank 224 via the hydraulic line 315 and the return line 316.

In examples, the meter-in valves 310, 322, the counterbalance valves 100A, 100B, the pressure reducing valves 324, 330, and the regeneration valve 602 as depicted in FIG. 6 can be referred to as a valve assembly 606. The valve assembly 606 can, for example, represents a manifold or block that has several cavities to house the meter-in valves 310, 322, the counterbalance valves 100A, 100B, the pressure reducing valves 324, 330, and the regeneration valve 602 and includes hydraulic passages and holes that form the hydraulic lines and connections between the valves and between the vales and other components of the hydraulic system 600.

In an example, an actuator can be a single-acting actuator where pressurized fluid is provided to one chamber of the actuator, rather than two chambers, to apply a force on one side of a piston of the actuator. For instance, the piston can extend by pressurized fluid but retracts through gravity or a spring. In this example, a valve assembly controlling fluid flow to and from the actuator can include one meter-in valve, one counterbalance valve, and one pressure reducing valve, rather than two of each.

Further, the hydraulic systems 300, 400, 500, and 600 depict two meter-in valves 310, 322, each controlling fluid flow to a chamber of the actuator 204. In other examples, a single four-way meter-in valve can be used to control fluid flow to both chambers 216, 218. For instance, the four-way meter-in valve can be a spool valve having a spool that, when shifted to one side, fluid flow is allowed from the first source 3002 of pressurized fluid to one of the chambers 216, 218. When the spool is shifted to the other side, fluid flow is allowed from the first source 3002 of pressurized fluid to the other chamber.

Figure 7:
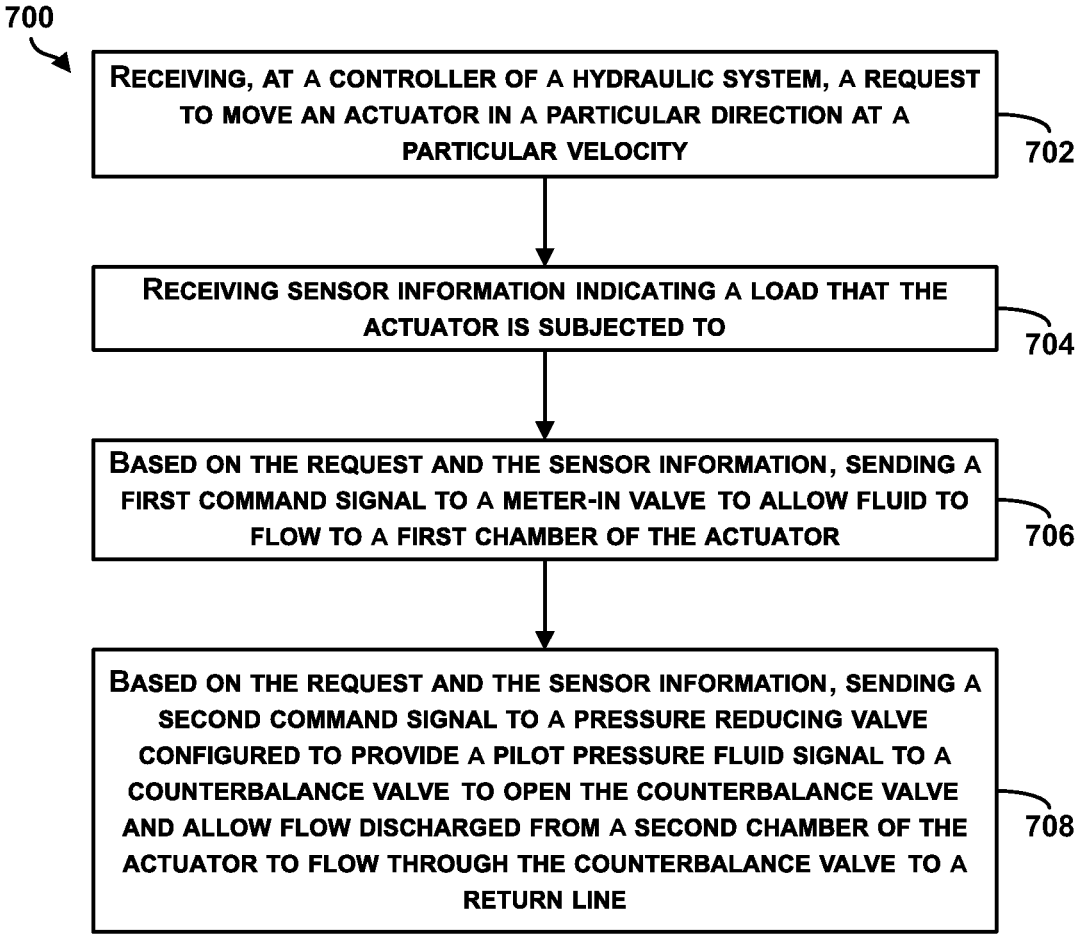
FIG. 7 a flowchart of a method for controlling a hydraulic system, in accordance with an example implementation.

FIG. 7 is a flowchart of a method 700 for controlling a hydraulic system, in accordance with an example implementation. The method 700 could, for example, be performed by a controller such as the controller 334 to control any of the hydraulic systems 300, 400, 500, or 600.

The method 700 may include one or more operations, or actions as illustrated by one or more of blocks 702-708. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

In addition, for the method 700 and other processes and operations disclosed herein, the flowchart shows operation of one possible implementation of present examples. In this regard, each block may represent a module, a segment, or a portion of program code, which includes one or more instructions executable by a processor or a controller for implementing specific logical operations or steps in the process. The program code may be stored on any type of computer readable medium or memory, for example, such as a storage device including a disk or hard drive. The computer readable medium may include a non-transitory computer readable medium or memory, for example, such as computer-readable media that stores data for short periods of time like register memory, processor cache and Random Access Memory (RAM). The computer readable medium may also include non-transitory media or memory, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, a tangible storage device, or other article of manufacture, for example. In addition, for the method 700 and other processes and operations disclosed herein, one or more blocks in FIG. 7 may represent circuitry or digital logic that is arranged to perform the specific logical operations in the process.

At block 702, the method 700 includes receiving, at the controller 334, a request to move an actuator in a particular direction (e.g., extend or retract the piston 208) at a particular velocity. The actuator 204 can, for example, represent one of the actuators (e.g., boom, crowd, or bucket) of a mobile hydraulic machine such as an excavator, a backhoe, or a loader. An operator may provide the request via a joystick or similar input device to the controller 334. For instance, if the operator moves the joystick in a particular direction, a signal is sent from the joystick to the controller 334 indicating a request to move a particular actuator (e.g., boom, crowd, or bucket) or a piston thereof in a particular direction at a particular velocity.

At block 704, the method 700 includes receiving sensor information (e.g., from the pressure sensors 336, 338, 340) indicating the load 214 that the actuator 204 is subjected to.

At block 706, the method 700 includes, based on the request and the sensor information, sending a first command signal to a meter-in valve to allow fluid to flow to a first chamber of the actuator. For example, if the request is associated with extending the piston 208, then the controller 334 sends a command signal $u_{in}$ to the meter-in valve 322, and the command signal $u_{in}$ is based on the velocity and the sensor information (see equation 2). If the request is associated with retracting the piston 208, then the controller 334 sends a command signal $u_{in}$ to the meter-in valve 310, and the command signal $u_{in}$ is based on the velocity and the sensor information (see equation 2).

At block 708, the method 700 includes, based on the request and the sensor information, sending a second command signal to a pressure reducing valve configured to provide a pilot pressure fluid signal to a counterbalance valve to open the counterbalance valve and allow flow discharged from a second chamber of the actuator to flow through the counterbalance valve to a return line. For example, if the request is associated with extending the piston 208, then the controller 334 sends a command signal $u_{out}$ to the pressure reducing valve 330 to open the counterbalance valve 100B. The command signal $u_{out}$ is determined so as to provide to the counterbalance valve 100B a pilot fluid pressure signal having a particular pressure level that is based on the sensor information indicating the load 214. If the request is associated with retracting the piston 208, then the controller 334 sends a command signal $u_{out}$ to the pressure reducing valve 324 to open the counterbalance valve 100A. The command signal $u_{out}$ is similarly determined so as to provide to the counterbalance valve 100A a pilot fluid pressure signal having a particular pressure level that is based on the sensor information indicating the load 214.

In examples, if the hydraulic system includes the regeneration valve 602 as discussed above with respect to the hydraulics system 600, the controller can be configured to provide a third command signal to the regeneration valve 602 so as to allow a portion of fluid to flow between the first chamber 216 and the second chamber 218.

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform functions presented in the figures. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

What is claimed is:

1. A valve assembly comprising:

a first meter-in valve configured to be fluidly coupled to a first source of pressurized fluid and control fluid flow from the first source of pressurized fluid into a first chamber of an actuator;

a second meter-in valve configured to control fluid flow from the first source of pressurized fluid into a second chamber of the actuator;

a counterbalance valve comprising: (i) a first port configured to be fluidly coupled to the second chamber of the actuator, (ii) a second port configured to be fluidly coupled to a tank, and (iii) a pilot port, wherein the counterbalance valve is configured to open and control fluid flow from the second chamber to the tank in response to a pilot pressure fluid signal received at the pilot port, and wherein the counterbalance valve is configured to allow for reverse flow from the second port to the first port of the counterbalance valve, such that fluid exiting the second meter-in valve, when the second meter-in valve is actuated, is received at the second port of the counterbalance valve and flows therethrough to the first port; and a pressure reducing valve configured to be fluidly coupled to a second source of pressurized fluid and to be fluidly coupled to the pilot port of the counterbalance valve, wherein the pressure reducing valve is configured to receive pressurized fluid from the second source of pressurized fluid and, when actuated, provide the pilot pressure fluid signal to the pilot port of the counterbalance valve, wherein the pilot pressure fluid signal has a reduced pressure level compared to pressurized fluid received from the second source of pressurized fluid.

2. The valve assembly of claim 1, further comprising:

a pressure compensator valve disposed downstream from the first source of pressurized fluid and configured to regulate fluid flow from the first source of pressurized fluid to the first meter-in valve, wherein the pressure compensator valve is configured to: (i) receive pressurized fluid from the first source of pressurized fluid, (ii) receive a fluid signal from fluid exiting the first meter-in valve, and (iii) provide fluid to the first meter-in valve at a particular pressure level such that a pressure drop across the first meter-in valve is substantially constant.

3. The valve assembly of claim 1, wherein the counterbalance valve is a first counterbalance valve, and the pressure reducing valve is a first pressure reducing valve, and wherein the valve assembly further comprises:

a second counterbalance valve configured to open and control fluid flow from the first chamber to the tank in response to a respective pilot pressure fluid signal received at a respective pilot port of the second counterbalance valve; and a second pressure reducing valve configured to receive pressurized fluid from the second source of pressurized fluid and, when actuated, provide the respective pilot pressure fluid signal to the respective pilot port of the second counterbalance valve.

4. The valve assembly of claim 3, wherein the first counterbalance valve is configured to be fluidly coupled to the second meter-in valve, such that fluid exiting the first counterbalance valve through the second port flows through the second meter-in valve, when the second meter-in valve is unactuated, prior to reaching the tank.

5. The valve assembly of claim 1, further comprising:

a regeneration valve that, when actuated, is configured to fluidly couple the first chamber of the actuator to the second chamber when actuated.

6. The valve assembly of claim 1, further comprising:

a first pressure sensor coupled to the first chamber and configured to indicate a pressure level within the first chamber;

a second pressure sensor coupled to the second chamber and configured to indicate a pressure level within the second chamber; and a controller configured to:

receive sensor information from the first pressure sensor and the second pressure sensor, receive a request to move the actuator at a particular velocity, send, based on the request, a first command to the first meter-in valve so as to provide fluid at a particular flow rate that achieves the particular velocity, and send, based on the sensor information, a second command to the pressure reducing valve so as to provide the pilot pressure fluid signal having a particular pressure level to the counterbalance valve.

7. The valve assembly of claim 6, further comprising a regeneration valve that, when actuated, is configured to fluidly couple the first chamber of the actuator to the second chamber, wherein the controller is further configured to:

send, based on the sensor information, a third command to the regeneration valve so as to allow a portion of fluid to flow between the first chamber and the second chamber.

8. A valve assembly comprising:

a first meter-in valve configured to be fluidly coupled to a first source of pressurized fluid and control fluid flow from the first source of pressurized fluid into a first chamber of an actuator;

a second meter-in valve configured to control fluid flow from the first source of pressurized fluid into a second chamber of the actuator;

a first counterbalance valve comprising: (i) a first port configured to be fluidly coupled to the second chamber of the actuator, (ii) a second port configured to be fluidly coupled to a tank, and (iii) a pilot port, wherein the first counterbalance valve is configured to open and control fluid flow from the second chamber to the tank in response to a pilot pressure fluid signal received at the pilot port;

a second counterbalance valve comprising: (i) a respective first port configured to be fluidly coupled to the first chamber of the actuator, (ii) a respective second port configured to be fluidly coupled to the tank, and (iii) a respective pilot port, wherein the second counterbalance valve is configured to open and control fluid flow from the first chamber to the tank in response to a respective pilot pressure fluid signal received at the respective pilot port;

a first pressure reducing valve configured to be fluidly coupled to a second source of pressurized fluid and to be fluidly coupled to the pilot port of the first counterbalance valve, wherein the first pressure reducing valve is configured to receive pressurized fluid from the second source of pressurized fluid and, when actuated, provide the pilot pressure fluid signal to the pilot port of the first counterbalance valve;

a second pressure reducing valve configured to be fluidly coupled to the second source of pressurized fluid and to be fluidly coupled to the respective pilot port of the second counterbalance valve, wherein the second pressure reducing valve is configured to receive pressurized fluid from the second source of pressurized fluid and, when actuated, provide the respective pilot pressure fluid signal to the respective pilot port of the second counterbalance valve;

a first pressure compensator valve configured to be disposed downstream from the first source of pressurized fluid and configured to regulate fluid flow from the first source of pressurized fluid to the first meter-in valve, wherein the first pressure compensator valve is configured to: (i) receive pressurized fluid from the first source of pressurized fluid, (ii) receive a fluid signal from fluid exiting the first meter-in valve, and (iii) provide fluid to the first meter-in valve such that a pressure drop across the first meter-in valve is substantially constant; and a second pressure compensator valve disposed downstream from the first source of pressurized fluid and configured to regulate fluid flow from the first source of pressurized fluid to the second meter-in valve, wherein the second pressure compensator valve is configured to: (i) receive pressurized fluid from the first source of pressurized fluid, (ii) receive a respective fluid signal from fluid exiting the second meter-in valve, and (iii) provide fluid to the second meter-in valve such that a pressure drop across the second meter-in valve is substantially constant.

9. The valve assembly of claim 8, wherein:

the first counterbalance valve is configured to be fluidly coupled to the second meter-in valve, such that fluid exiting the first counterbalance valve through the second port flows through the second meter-in valve, when the second meter-in valve is unactuated, prior to reaching the tank, and the second counterbalance valve is configured to be fluidly coupled to the first meter-in valve, such that fluid exiting the second counterbalance valve through the respective second port flows through the first meter-in valve, when the first meter-in valve is unactuated, prior to reaching the tank.

10. The valve assembly of claim 8, wherein:

the first counterbalance valve is configured to allow for reverse flow from the second port to the first port of the first counterbalance valve, such that fluid exiting the second meter-in valve, when the second meter-in valve is actuated, is received at the second port of the first counterbalance valve and flows therethrough to the first port, and the second counterbalance valve is configured to allow for reverse flow from the respective second port to the respective first port of the second counterbalance valve, such that fluid exiting the first meter-in valve, when the first meter-in valve is actuated, is received at the respective second port of the first counterbalance valve and flows therethrough to the respective first port.

11. The valve assembly of claim 8, further comprising:

a regeneration valve that, when actuated, is configured to fluidly couple the first chamber of the actuator to the second chamber when actuated.

12. The valve assembly of claim 8, further comprising:

a first pressure sensor coupled to the first chamber and configured to indicate a pressure level within the first chamber;

a second pressure sensor coupled to the second chamber and configured to indicate a pressure level within the second chamber; and a controller configured to:

receive sensor information from the first pressure sensor and the second pressure sensor, receive a request to move the actuator at a particular velocity in a particular direction, send, based on the request, a first command to the first meter-in valve or the second meter-in valve so as to provide fluid at a particular flow rate to the first chamber or the second chamber of the actuator, and send, based on the request and the sensor information, a second command to the first pressure reducing valve or the second pressure reducing valve so as to provide the pilot pressure fluid signal or the respective pilot pressure fluid signal to the first counterbalance valve or the second counterbalance valve.

13. The valve assembly of claim 12, further comprising a regeneration valve that, when actuated, is configured to fluidly couple the first chamber of the actuator to the second chamber, wherein the controller is further configured to:

send, based on the sensor information, a third command to the regeneration valve so as to allow a portion of fluid to flow between the first chamber and the second chamber.

14. A hydraulic system comprising:

a first source of pressurized fluid;

a second source of pressurized fluid;

a tank;

an actuator having a first chamber and a second chamber;

a first pressure sensor coupled to the first chamber and configured to indicate a pressure level within the first chamber;

a second pressure sensor coupled to the second chamber and configured to indicate a pressure level within the second chamber;

a valve assembly comprising:

a meter-in valve configured to be fluidly coupled to the first source of pressurized fluid and control fluid flow from the first source of pressurized fluid into the first chamber of the actuator, a counterbalance valve comprising: (i) a first port configured to be fluidly coupled to the second chamber of the actuator, (ii) a second port configured to be fluidly coupled to the tank, and (iii) a pilot port, wherein the counterbalance valve is configured to open and control fluid flow from the second chamber to the tank in response to a pilot pressure fluid signal received at the pilot port, and a pressure reducing valve configured to be fluidly coupled to the second source of pressurized fluid and to be fluidly coupled to the pilot port of the counterbalance valve, wherein the pressure reducing valve is configured to receive pressurized fluid from the second source of pressurized fluid and, when actuated, provide the pilot pressure fluid signal to the pilot port of the counterbalance valve, wherein the pilot pressure fluid signal has a reduced pressure level compared to pressurized fluid received from the second source of pressurized fluid; and a controller configured to:

receive sensor information from the first pressure sensor and the second pressure sensor, receive a request to move the actuator at a particular velocity, send, based on the request, a first command to the meter-in valve so as to provide fluid at a particular flow rate that achieves the particular velocity, and send, based on the sensor information, a second command to the pressure reducing valve so as to provide the pilot pressure fluid signal to the counterbalance valve.

15. The hydraulic system of claim 14, wherein the valve assembly further comprises:

a pressure compensator valve disposed downstream from the first source of pressurized fluid and configured to regulate fluid flow from the first source of pressurized fluid to the meter-in valve, wherein the pressure compensator valve is configured to: (i) receive pressurized fluid from the first source of pressurized fluid, (ii) receive a fluid signal from fluid exiting the meter-in valve, and (iii) provide fluid to the meter-in valve at a particular pressure level such that a pressure drop across the meter-in valve is substantially constant.

16. The hydraulic system of claim 14, wherein the meter-in valve is a first meter-in valve, the counterbalance valve is a first counterbalance valve, and the pressure reducing valve is a first pressure reducing valve, and wherein the valve assembly further comprises:

a second meter-in valve configured to control fluid flow from the first source of pressurized fluid into the second chamber of the actuator;

a second counterbalance valve configured to open and control fluid flow from the first chamber to the tank in response to a respective pilot pressure fluid signal received at a respective pilot port of the second counterbalance valve; and a second pressure reducing valve configured to receive pressurized fluid from the second source of pressurized fluid and, when actuated, provide the respective pilot pressure fluid signal to the respective pilot port of the second counterbalance valve.

17. The hydraulic system of claim 16, wherein the first counterbalance valve is configured to be fluidly coupled to the second meter-in valve, such that fluid exiting the first counterbalance valve through the second port flows through the second meter-in valve, when the second meter-in valve is unactuated, prior to reaching the tank.

18. The valve assembly of claim 16, wherein the first counterbalance valve is configured to allow for reverse flow from the second port to the first port of the first counterbalance valve, such that fluid exiting the second meter-in valve, when the second meter-in valve is actuated, is received at the second port of the first counterbalance valve and flows therethrough to the first port.

19. The hydraulic system of claim 14, wherein the valve assembly further comprises:

a regeneration valve that, when actuated, is configured to fluidly couple the first chamber of the actuator to the second chamber.

20. The hydraulic system of claim 19, wherein the controller is further configured to:

send, based on the sensor information, a third command to the regeneration valve to actuate the regeneration valve so as to allow a portion of fluid to flow between the first chamber and the second chamber.

* * * * *